US006418731B1

(12) United States Patent
Anthony

(10) Patent No.: US 6,418,731 B1
(45) Date of Patent: Jul. 16, 2002

(54) SELF-COOLING CONTAINER WITH INTERNAL BEVERAGE RECEPTACLE AND PROCESS OF MANUFACTURING SELF-COOLING CONTAINER

(76) Inventor: Michael M. Anthony, 10189 W. Sample Rd., Cora Springs, FL (US) 33065

( * ) Notice: Subject to any disclaimer, the term of this patent is extended or adjusted under 35 U.S.C. 154(b) by 0 days.

(21) Appl. No.: 09/612,707

(22) Filed: Jul. 10, 2000

(51) Int. Cl.[7] ..... B65B 63/08

(52) U.S. Cl. ..... 62/60; 62/77

(58) Field of Search ..... 62/60, 294, 371, 62/77, 293

(56) References Cited

U.S. PATENT DOCUMENTS 5,845,501 A * 12/1998 Stonehouse et al. ..... 62/62
6,065,300 A * 5/2000 Anthony ..... 62/293

* cited by examiner

*Primary Examiner*—Denise L. Esquivel
*Assistant Examiner*—Malik N. Drake
(74) *Attorney, Agent, or Firm*—Oltman, Flynn & Kubler

(57) ABSTRACT

A self-cooling container apparatus for retaining a food item, including a container having a tubular container side wall and a container bottom wall having a certain configuration and being integrally joined to the container side wall and having a container lid; a receptacle having a tubular receptacle side wall and a receptacle bottom wall integrally joined to the receptacle side wall, the receptacle bottom wall having a configuration matching the certain configuration of the container bottom wall and abutting the container bottom wall such that pressure greater than ambient pressure within the receptacle is fully transmitted to the container bottom wall to enhance container column strength; the receptacle side wall and container side wall being spaced apart from each other to define therebetween an annular space for retaining refrigerant, the container side wall having a container side wall upper end configured as a container rim and the receptacle side wall having a receptacle side wall upper end configured as a receptacle rim which rests on the container rim and is sealed to the container rim upon affixing of the container lid over the receptacle rim and the container rim; and a food item release mechanism for releasing the food item from the receptacle and the container. A process of manufacturing the above-described self-cooling container apparatus for retaining a food item is provided, including the steps of orienting the receptacles for insertion into containers; inserting each receptacle into a container; filling each receptacle with a food item; filling the annular space between the container side wall and the receptacle side wall with refrigerant; and charging the annular space between the receptacle and container with refrigerant.

24 Claims, 21 Drawing Sheets

| Operation | Blow Molding of the receptacle | Insertion of the receptacle 24 in container 20. | Filling of the Assembly 300 with beverage. | Charging the filled and seamed assembly 300 with refrigerant mixture. |
|---|---|---|---|---|
| Routing | Preforms are shipped from a manufacturer or manufactured on site and then blown into bottles. | Bottles are trimmed and inserted into the cans by a special inserter. | The Containers are filled with beverage and then seamed in a conventional beverage filling line. | The containers are charged-offline by a special charger. |
| Location | As close to the can making plant as possible. | In the same location as the blow-molding station. | In the Beverage filling plant. | As close to the beverage filling lines as possible. |
| Preparation needed | The operation will need preforms to be made or shipped to the location.<br>A plant site must be identified, prepared and setup. Storage for at least 10 million preforms, cleaners, solvents for operation | The operation is linked via conveyor to the blow-molding setup. The operation must be accommodated by the blow-mold setup facility. The operation links into the can plant output conveyors for the Cold Pack Cans. The operation is offline to the can plants.<br>The operation is linked to the can palletizing and packing stations. Requires separate storage from finished product, probably inside can plant, or close to it. | This operation is contingent in the bottling lines. Does not require any modifications, other than preparation of fill rates and CO2 adjustments.<br>May require separate waste discard procedures. | This operation is connected to the beverage output lines by a can conveyor. The filled cans are conveyed to the charger station. Requires some storage space for rejects, and possible accumulation off-line. This operation is linked to the packaging operation of the bottling lines by conveyor. |
| Special requirements | Conveyor tie-ins to can making plant. Will require identification of the tie-in process, available spaces, line speed for off-line links, power requirements, regulations, etc. | Conveyor tie-ins to blow-molding and can making plant. Will require identification of the tie-in process, available spaces, line speed for off-line links, power requirements, regulations, etc. | Will require identification of beverage filling lines, capacities, filling procedures, rates, amounts, etc. | Conveyor tie-ins to bottling line outputs. Will require identification of the tie-in process, available spaces, line speed for off-line links, power requirements, regulations, etc.<br>Will also require a complete identification of what processes need to be modified in plant, ex. Labeling, weights etc. |

*Fig. 18*

Filling Line Process

Charger Configuration and Process

SELF-COOLING CONTAINER WITH INTERNAL BEVERAGE RECEPTACLE AND PROCESS OF MANUFACTURING SELF-COOLING CONTAINER

BACKGROUND OF THE INVENTION

1. Field of the Invention

The present invention relates generally to the field of food and beverage containers and to processes for manufacturing such containers. More specifically the present invention relates to a method of manufacturing a self-cooling container apparatus holding a carbonated beverage or other food item as described in U.S. Pat. No. 6,065,300 and to an improved container apparatus. The containers preferably contain a beverage, but other products are contemplated.

The apparatus includes an improved plastic receptacle which deforms laterally into a substantially cylindrical shape to fit into a plastic bottle or a metal container during manufacture. The receptacle is designed to be handled easily for manufacturing the self-cooling container, so that the processes that would be encountered during the manufacturing would be easily accomplished because of the way the receptacle is designed. The receptacle is further configured to match the shape of the bottom dome of a metal container to fully abut said bottom dome of the container so that during the beverage filling process, nitrogen or carbonation pressure transmitted from the beverage filler head to the inside space of the receptacle is fully transmitted to the bottom dome of the container and the pressure within the receptacle makes the receptacle rigid and stiff, and gives the container and receptacle combination the same column strength as pressurized container without a receptacle. The pressurization of the container with carbon-dioxide gas is important when carbonated beverage are being filled to ensure that the carbonation of the beverage occurs during the filling process. The beverage itself is usually uncarbonated until it enters the container, where, because of the absorption of pressurized carbon-dioxide gas, it becomes carbonated. For a container without the receptacle, the container column strength is obtained by the filler head firmly forming a seal with the empty open container rim and pressurizing the container directly with a blast of carbon-dioxide gas. The column strength of the container is obtained by the internal pressure of the container. This allows the filler head to firmly seal the rim of the container to maintain the pressure of the beverage during the filling process. However with the receptacle inside the container, the container no longer holds the carbonation pressure, and thus has very little column strength. By abutting the receptacle base directly, firmly and uniformly over the bottom inside base dome of the container and the bottom rim, the receptacle becomes rigid, strong and slightly taller than the container due to the pressure. Thus, during filling, the receptacle advantageously transmits the filler head forces directly to the container bottom dome wall without subjecting the container walls to deformation stresses. The slight elevation of the receptacle during the carbonated beverage filling process helps prevent direct contact of the weak unpressurized container walls with the filler head seal.

Other improvements to the apparatus include a refrigerant valve mounting structure centrally located on the receptacle bottom wall. The method of manufacture generally involves the broad steps of injection molding preforms from plastic material, blow molding the receptacle to a shape of particular form; cutting the top blow-domes of the manufactured receptacle with a laser or with a knife edge to obtain a uniform flange; orienting the receptacles for insertion into containers; inserting each receptacle into a container; filling the receptacle with beverage; seaming the container lid onto the receptacle and container flanges; checking for carbonation column strength of the filled and seamed container; and charging the annular space between the receptacle and container with refrigerant mixture; checking for refrigerant mixture leaks.

2. Description of the Prior Art

There have previously been self-cooling containers for food items including flexible and deformable beverage receptacles with widely spaced apart, rigid receptacle walls, and methods of manufacturing these containers. These prior art do not address the real issues of manufacturing and beverage plant operations that are crucial for the success of a self-cooling beverage container program. All prior art designs fail when subjected to the immense pressures (about 45 psi) of the carbonated filling process and fail to maintain the container column strength. The sudden blast of carbon-dioxide inside a container during filling, can destroy any thin-walled internal container, and collapse its walls so that the functionality of the apparatus will be impaired. Also, the sudden collapse of such internal containers, can cause the container itself to loose column strength, and collapse under the clamping force that is applied for sealing the container during filling. Many trials and designs were done to obtain the present configuration of the disclosed receptacle of this invention.

For example when an internal receptacle is used as a refrigerant storage receptacle, the beverage filler head pressurizes its external walls and crushes the receptacle, since such receptacles are generally made from thin walled materials for rapid heat transfer, they can be easily crushed by external pressure and cannot survive the forces of the high speed manufacturing process. Thus, failure of the internal receptacle, can also result in the sudden collapse of the container walls. Even with prior designs of co-seamed internal receptacles such as that described in U.S. Pat. No. 6,065,300 to the present inventor the problem was still not solved. Also, the high speed beverage plants require high speed compatible operations for manufacture of an online self-cooling beverage container. For example, prior art designs do not address easy valve insertion, self-aligning of the receptacle with the container and so on. Further, most prior art relies on a separate unintegrated manufacturing process for the attachment of the receptacle to the container.

Thus, a program to develop a self-cooling container that can address the rigors of the filling and the seaming stresses, as well as the tensions of processes such as beer pasteurization, must include the embodiments of the present improved invention. To operate the present invention for use as a self-cooling container, a valve is provided that is opened and a refrigerant mixture is progressively discharged from the receptacle, extracting heat from the container contents.

It is thus an object of the present invention to provide a self-cooling container and method of manufacturing a self-cooling container apparatus, the apparatus containing a beverage receptacle with a shape changing section, to either expand or contract the receptacle for easy insertion into the container.

It is another object of the present invention to provide a self-cooling container apparatus containing a beverage receptacle which is designed in a pre-expanded shape with a maximal volume, and with a pressure transfer bottom wall that transmits the carbonation beverage filling pressure directly to the container bottom wall to prevent the container side wall from collapsing.

It is an objective of the present invention to provide an apparatus and method of manufacture, that uses a receptacle that can contract to a smaller volume for easy insertion into the container, and then receptacle be re-expanded back to its original maximum volume state and that does not substantially expand after said re-expansion during the pressurized filling process to maintain stiffness and column strength.

It is another object of the present invention to provide such an apparatus in which a smaller volume of refrigerant mixture is exposed to a larger heat transfer surface area such as by corrugating the beverage receptacle wall, to increase the evaporation rate of the liquid refrigerant mixture.

It is an objective of the present invention to provide an apparatus and method of manufacture, that uses a beverage receptacle that can be seamed with the container and the lid so that a refrigerant mixture can be charged into the space between the container and the receptacle, causing the receptacle to contract to a smaller volume and allow the refrigerant to equilibrate in pressure with the internal receptacle pressure.

It is still another object of the present invention to provide such an apparatus which can be manufactured and assembled together in a simple series of steps.

It is an object of the present invention to provide such an apparatus which is inexpensive to manufacture, safe and reliable.

It is finally an object of the present invention to provide such an apparatus which can be flexible, and yet does not substantially change the head space of a beverage after filling and seaming.

SUMMARY OF THE INVENTION

The present invention accomplishes the above-stated objectives, as well as others, as may be determined by a fair reading and interpretation of the entire specification.

A self-cooling container apparatus for retaining a food item, including a container having a tubular container side wall and a container bottom wall having a certain configuration and being integrally joined to the container side wall and having a container lid; a receptacle having a tubular receptacle side wall and a receptacle bottom wall integrally joined to the receptacle side wall, the receptacle bottom wall having a configuration matching the certain configuration of the container bottom wall and abutting the container bottom wall such that pressure greater than ambient pressure within the receptacle is fully transmitted to the container bottom wall to enhance container column strength; the receptacle side wall and container side wall being spaced apart from each other to define therebetween a substantial annular space for retaining a two or three phase refrigerant mixture, the container side wall having a container side wall upper end configured as a container upper open rim with an outwardly angled container flange and the receptacle side wall having a receptacle side wall upper end configured as a receptacle flange which rests on the container flange and is sealed to the container flange upon affixing of the container lid over the receptacle flange and the container flange; and a food item release mechanism for releasing the food item from the receptacle and the container.

The container flange preferably is angled outwardly from the container upper open rim and the receptacle flange preferably is angled outwardly. The apparatus preferably additionally includes a refrigerant passing container port fitted with a refrigerant valve for receiving and releasing refrigerant. The refrigerant passing container port preferably is located in the container bottom wall. The configuration of the container bottom wall preferably includes an outwardly protruding annular container bottom wall rim on which the container rests; and the configuration of the receptacle bottom wall preferably an outwardly protruding annular receptacle bottom wall rim corresponding in size and shape to the container bottom wall rim so that the receptacle bottom wall rim nests within and abuts the container bottom wall rim and transmits pressure within the receptacle to the container bottom wall rim.

The refrigerant valve preferably is a check valve permitting refrigerant mixture to flow into the annular space between the receptacle side wall and the container side wall, and prevents the refrigerant mixture from escaping from the container unless released by manually operation of the refrigerant valve. The refrigerant valve receiving structure optionally includes an annular barrel protruding downwardly from the receptacle bottom wall; a check valve fitting closely within the annular barrel, the annular barrel being positioned to register with a downward deformation of the container bottom wall defining a hollow cylinder structure with a conical tip segment at the lower end of the hollow cylinder structure, the refrigerant passing container port being located at the lower end of the conical tip segment; and a sealing check valve within the hollow cylinder structure resting within and sealing the conical tip section against refrigerant mixture flowing out of the container through the refrigerant passing container port by virtue of the refrigerant mixture pressure of acting on said sealing check valve against ambient pressure, and which enters the annular barrel and moves away from the refrigerant passing container port when displaced mechanically by a refrigerant mixture charge valve stem 42 during refrigerant charging into the container, or by manually depressing an exposed portion of said check valve to cool the product. The refrigerant valve receiving structure preferably includes a tubular flange formed into the container bottom wall and opening at its lower end to define the refrigerant passing container port; and a self-contained check valve fitted sealingly within the tubular flange. The apparatus preferably additionally includes a refrigerant drainage channel depressed inwardly into the receptacle bottom wall and extending radially from the refrigerant valve to and out of the side of the receptacle; so that during charging, the refrigerant in liquid state charged into the container during refrigerant filling and remaining liquid after refrigerant filling and after temperature and pressure equilibration with the surrounding atmosphere after the apparatus is charged and stored and remaining at the bottom of the container between the container bottom wall and the receptacle bottom wall drains through the refrigerant drainage channel and along the annular space upon inversion of the container by a user to open the refrigerant valve to release the refrigerant to cool the food item, so that liquid refrigerant is not adjacent to the refrigerant valve and does not spray out of the container upon opening of the refrigerant valve.

A self-cooling container apparatus is further provided for retaining a food item, including a container having a tubular container side wall and a container bottom wall having a certain configuration and being integrally joined to the container side wall and having a container lid; a receptacle having a tubular receptacle side wall and a receptacle bottom wall integrally joined to the receptacle side wall; the receptacle side wall and container side wall being spaced apart from each other to define therebetween an annular space for retaining refrigerant, the receptacle tubular side wall including two axially separated half tube segments interconnected by integral axial and inwardly protruding side wall channels which define side wall bowing segments, the receptacle having a wider annular mid-section between the top and bottom of the receptacle, so that application of a certain inwardly directed force to the bowing segment ridges causes the ridges to become inverted to protrude into the receptacle and the depressed ridges to protrude more deeply inwardly and the remainder of the side wall bowing segments to draw closer together, reducing the receptacle cross-section sufficiently to fit into the container; and a food item release mechanism for releasing the food item from the receptacle and the container. The receptacle side wall preferably includes surface area increasing undulations for enhancing heat transfer through the receptacle side wall during refrigerant mixture release for more rapid and efficient cooling of the food item within the receptacle. The receptacle side wall preferably includes an outwardly protruding bulge stop, located close to the upper end of the receptacle side wall, which abuts the container flange after receptacle insertion into the container, through the container open upper rim for resisting movement of the receptacle out of the container.

A process of manufacturing the above-described self-cooling container apparatus for retaining a food item is provided, including the steps of orienting the receptacles for insertion into containers; inserting each receptacle into a container; filling each receptacle with beverage; filling the annular space between the container side wall and the receptacle side wall with refrigerant; seaming or crimping the container lid onto the container flange and the receptacle flange combined; and charging the annular space between the receptacle and container with refrigerant.

A process of manufacturing the self-cooling container apparatus for retaining a food item is further provided, including the steps of orienting the receptacles for insertion into containers; applying a certain inwardly directed force to the bowing segment ridges to cause the ridges to become inverted to protrude into the receptacle and the ridges to protrude more deeply inwardly and the remainder of the side wall bowing segments to draw closer together, reducing the cross-section of the receptacle sufficiently to fit into the container; inserting each the receptacle into a container; filling each receptacle with beverage; filling the annular space between the container side wall and the receptacle side wall with refrigerant; seaming the container lid onto the container; and charging the annular space between the receptacle and container with refrigerant. The certain inwardly directed force preferably is applied by creating at least a partial vacuum within each receptacle and mechanically pushing the receptacle bottom wall into the container. It is important that the maximum diameter of the receptacle be less that the diameter of the container side wall, so that the receptacle side wall never contacts the container side wall after insertion, since this could create radial and lateral stresses.

A process of manufacturing the self-cooling container apparatus for retaining a food item is further provided, including the steps of delivering a series of the receptacles to an orientation wheel on a receptacle conveyor mechanism; sequentially capturing the receptacles in the receptacle holding recesses along the circumference of the orientation wheel so that the receptacles are held loosely and co-axially as the orientation wheel rotates; placing below each receptacle an opening containing a substantially vertical spindle, so that the bottom wall of receptacles oriented upright rest on the spindles, and so that receptacles oriented up-side down receive the given the spindle below the given receptacle and slide onto the spindle and out of the orientation wheel; delivering the upright the receptacles remaining in the orientation wheel to a receptacle insertion station; inserting each receptacle into a container; filling each receptacle with beverage; filling the annular space between the container side wall and the receptacle side wall with refrigerant; seaming the container lid onto the container; and charging the annular space between the receptacle and container with refrigerant.

A receptacle orientation station is provided for orienting receptacles for insertion into containers to form self-cooling container structures for retaining food items, the orientation station including several receptacles, each having a tubular receptacle side wall and a receptacle bottom wall integrally joined to the receptacle side wall; a receptacle delivery mechanism for conveying a series of the receptacles; a receptacle wheel being rotatably and having a receptacle wheel rotation drive mechanism, the receptacle wheel having a receptacle wheel circumference with a series of spaced apart receptacle receiving recesses along the circumference the receptacle wheel, each recess for receiving and retaining a receptacle delivered to the receptacle wheel by the receptacle delivery mechanism, the recesses holding the receptacles substantially co-axially as the receptacle wheel rotates; several receptacle spindles, each receptacle spindle being located beneath each recess substantially along the axis of each receptacle in each recess; so that any of the receptacles oriented with the receptacle opening facing the spindle fall down around the spindle below the recesses, and so that any of the receptacles oriented with the receptacle opening facing away from their respective spindles rest on top of the spindles and continue to rotate with the receptacle wheel; and so that any of the receptacles remaining within the receptacle wheel simply rest on the orientation spindle as the receptacle wheel rotates for removal to another manufacturing station and any of the receptacles having exited their receptacles and resting around their respective spindles are removed for reorientation.

The spindles preferably retractably extend through ports in a orientation spindle wheel and the apparatus preferably further includes a spindle retraction mechanism which retract the spindles out of any of the receptacles resting over the spindles, so that the receptacles are freed from removal from the reorientation station. The orientation station preferably additionally includes an orientation cam in camming contact with the spindles for retracting the spindles into and extending the spindles out of the orientation spindle wheel such that the spindles fall below the flanges of receptacles resting over the spindles so that any of the receptacles dropping over the spindles are delivered by rotation of the orientation spindle wheel to a recycling station where the receptacles are again delivered by to the orientation station.

BRIEF DESCRIPTION OF THE DRAWINGS

Various other objects, advantages, and features of the invention will become apparent to those skilled in the art from the following discussion taken in conjunction with the following drawings, in which:

FIG. 18 is a process description chart of the manufacturing process of the apparatus according to the preferred embodiment of the invention.

DETAILED DESCRIPTION OF THE PREFERRED EMBODIMENTS

Figure 1:
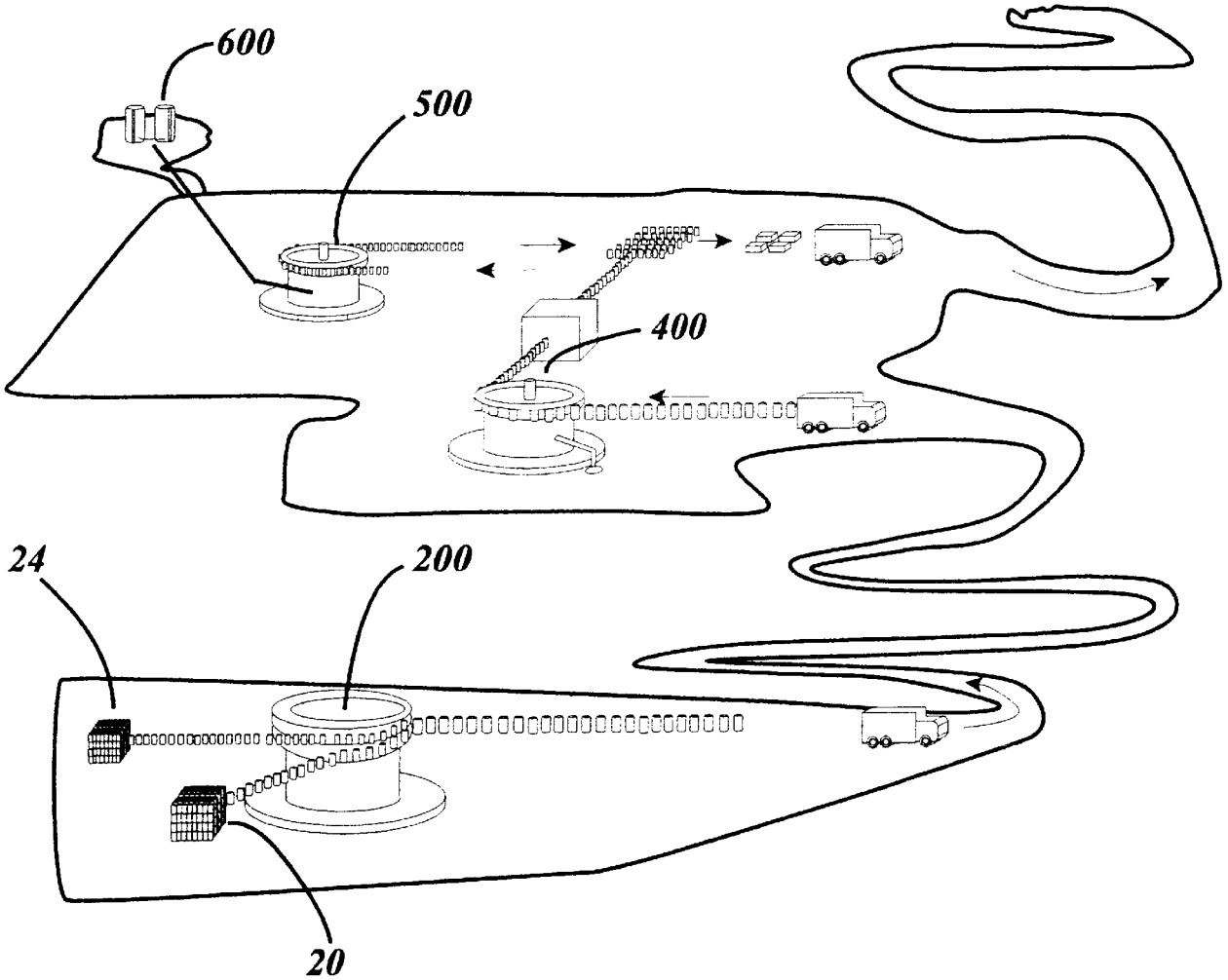
FIG. 1 is a schematic of the manufacturing process of the apparatus of this invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Figure 2:
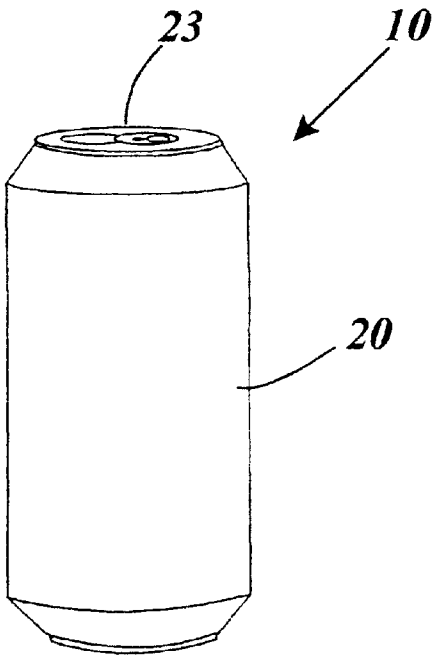
FIG. 2 shows a container with the receptacle inside and a beverage inside the receptacle with a lid seamed over the combination.
Figure 3:
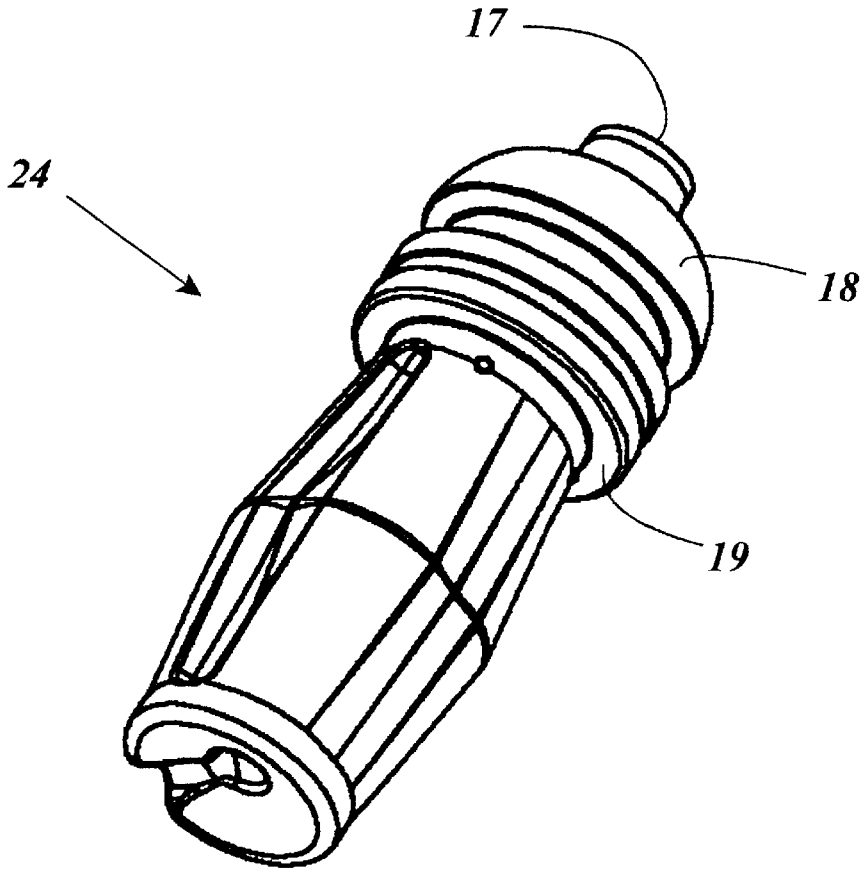
FIG. 3 shows a blow molded receptacle before making the receptacle flange.
Figure 4:
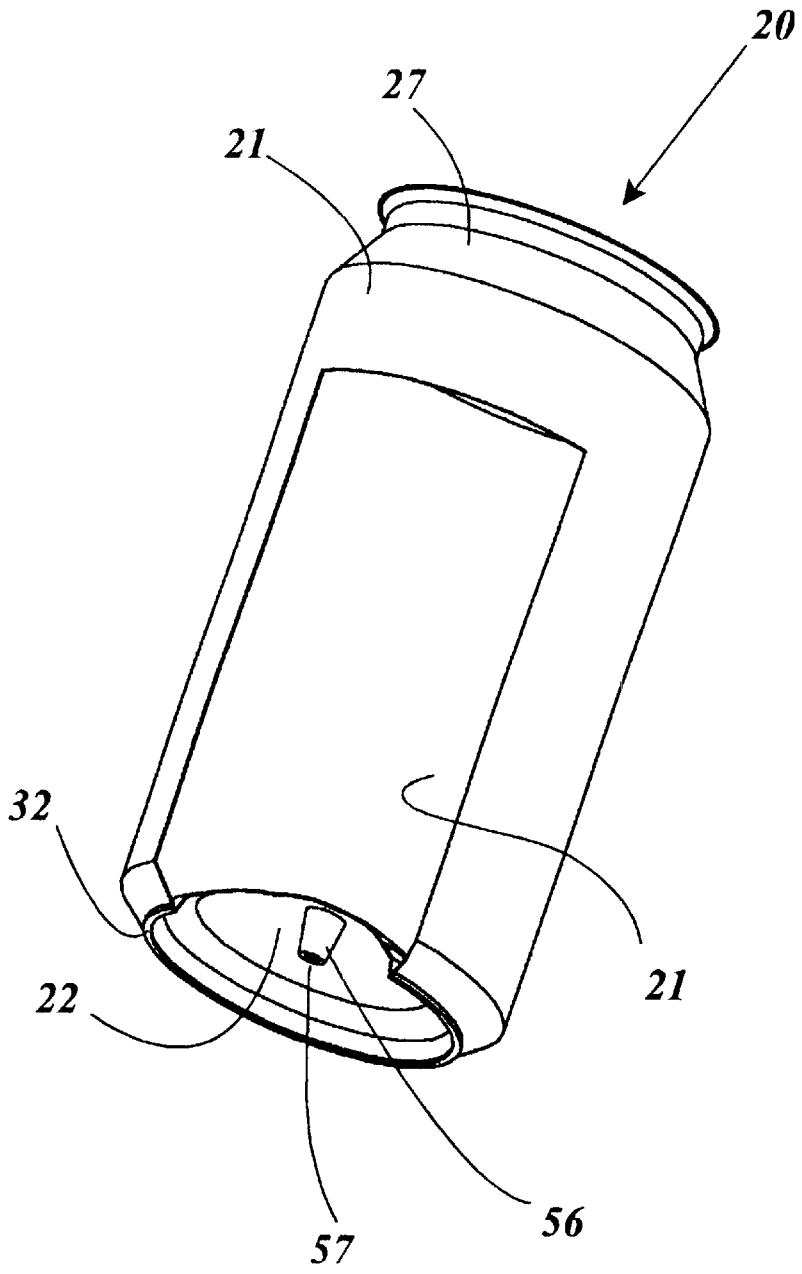
FIG. 4 a cutout of a container, showing the bottom wall and the valve seat.
Figure 5:
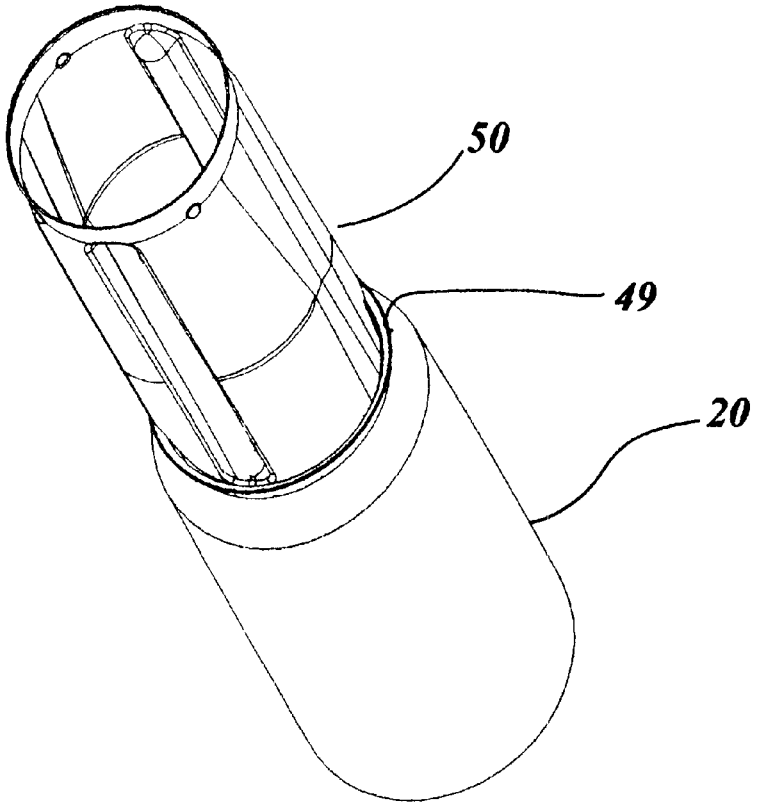
FIG. 5 shows the receptacle in its substantially cylindrical form as it enters the container.
Figure 6:
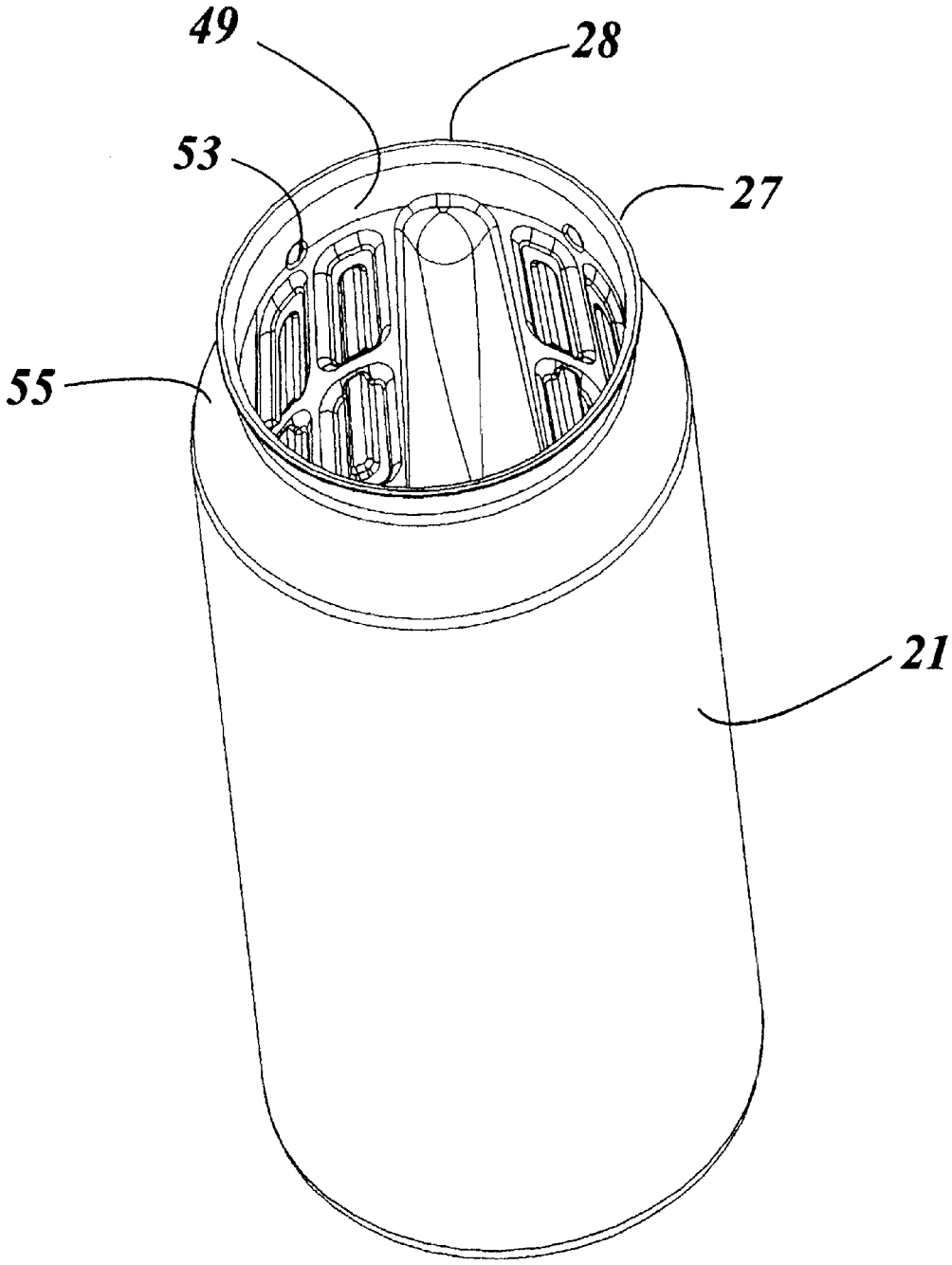
FIG. 6 shows the receptacle inside the container.
Figure 7:
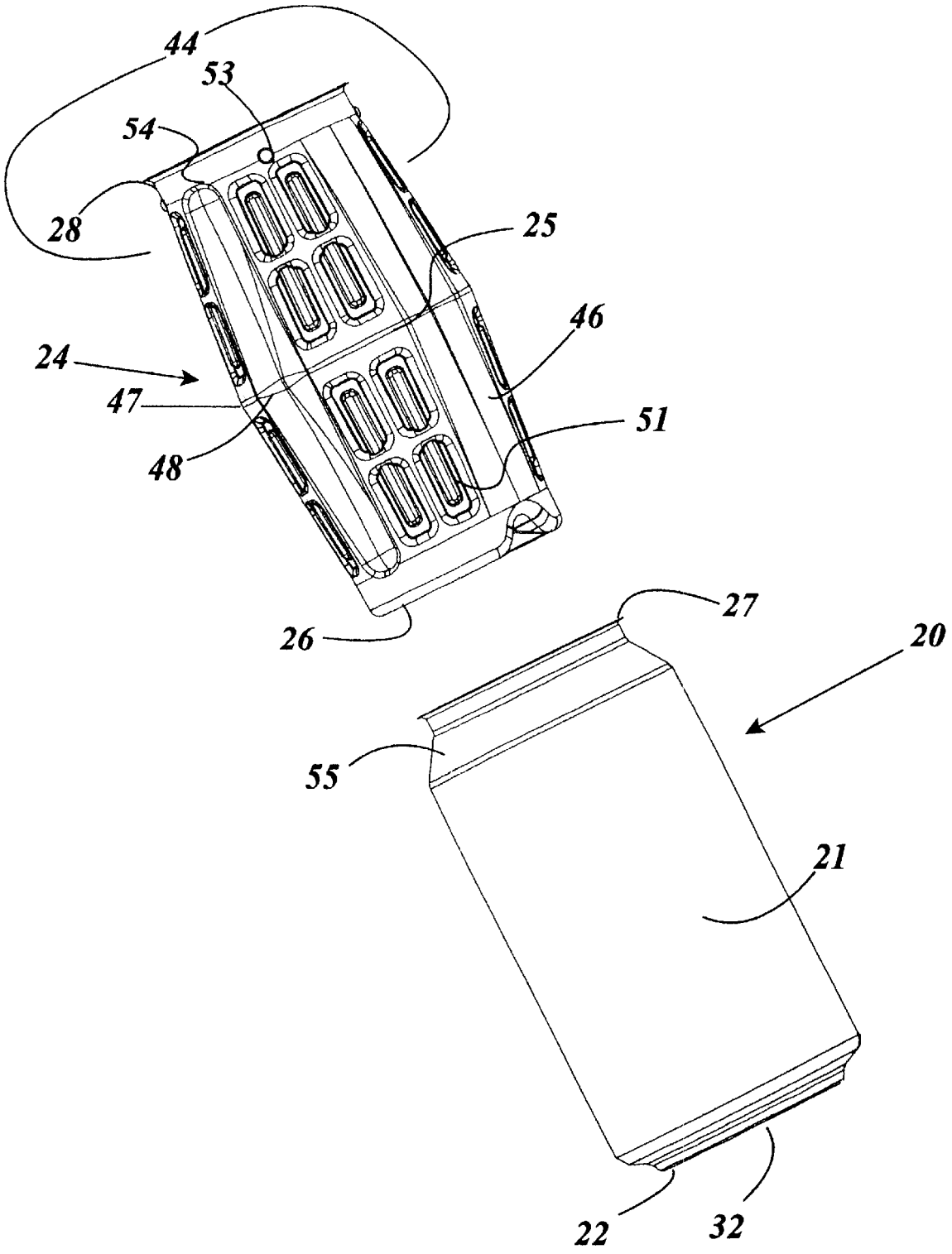
FIG. 7 shows some detail of the receptacle and the container before the receptacle is inserted.
Figure 8:
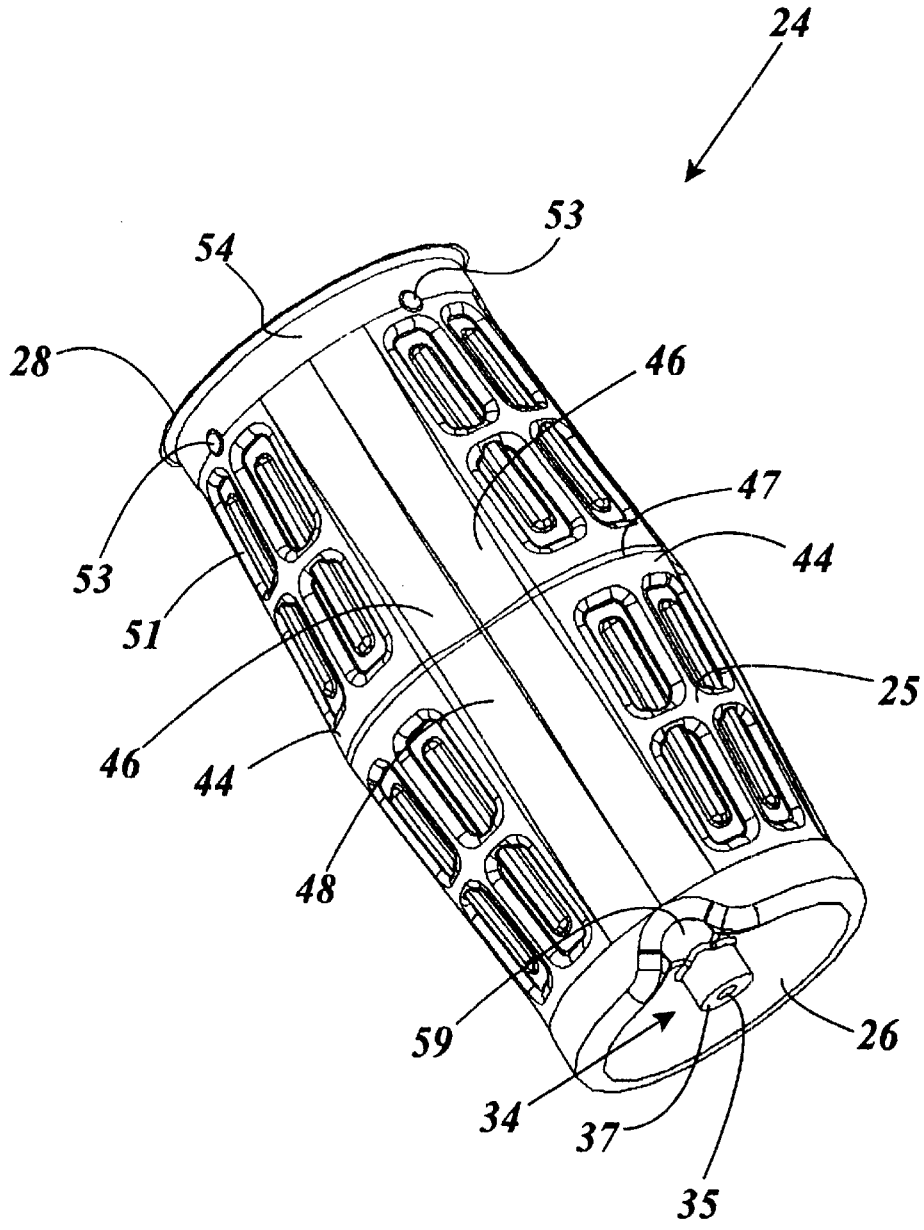
FIG. 8 shows details of the receptacle according to the preferred embodiment of the present invention.
Figure 9:
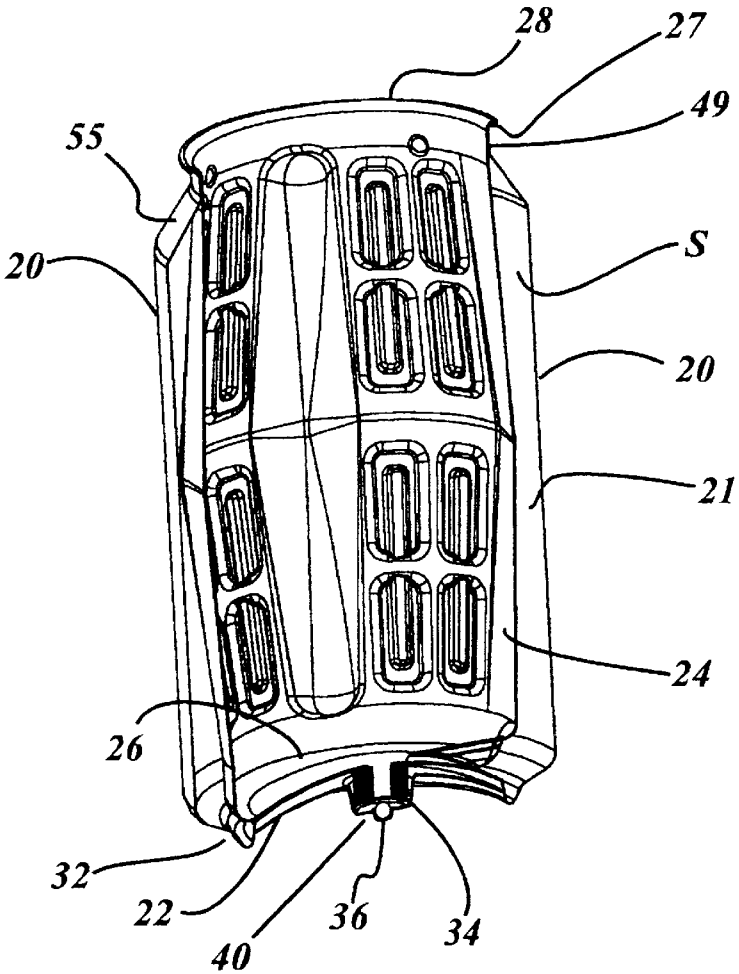
FIG. 9 shows a cutaway view of the receptacle, the check valve and the container.
Figure 10:
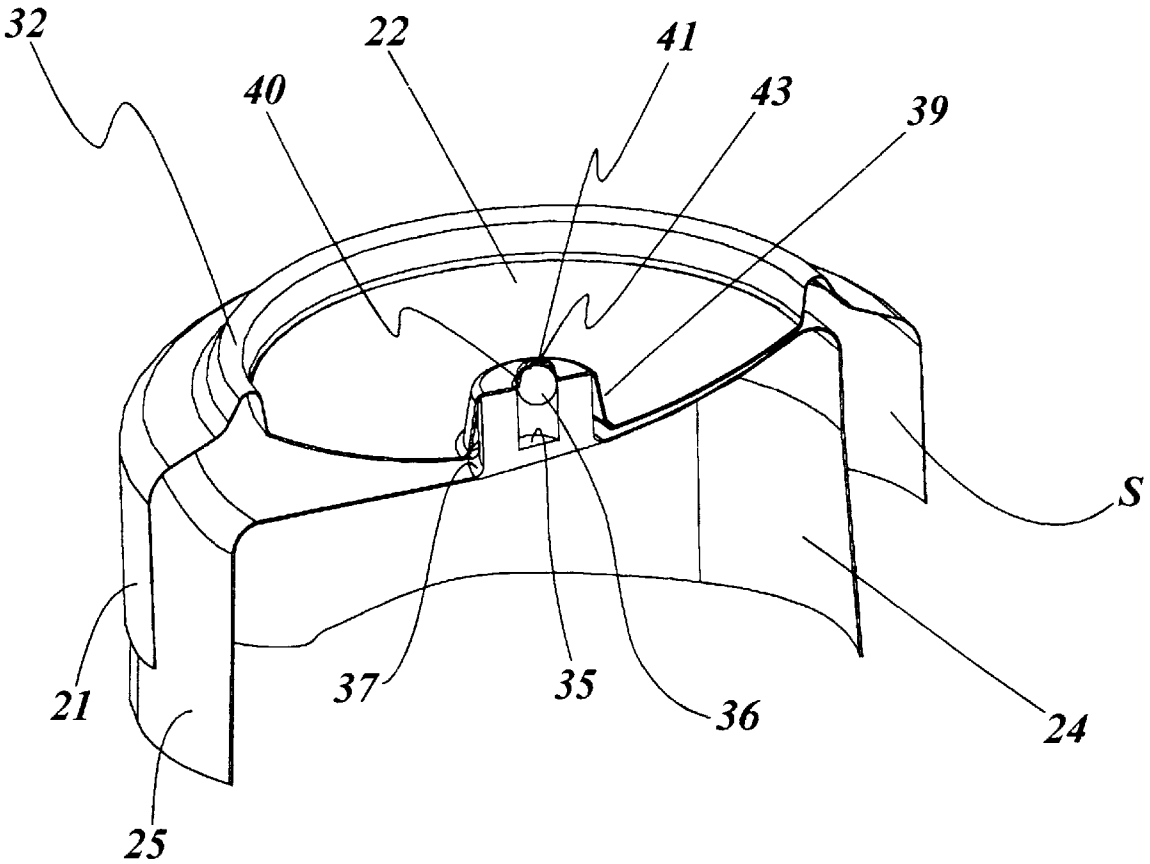
FIG. 10 shows a cutaway view of the base of the apparatus with details of the valve seat and the check valve.
Figure 11:
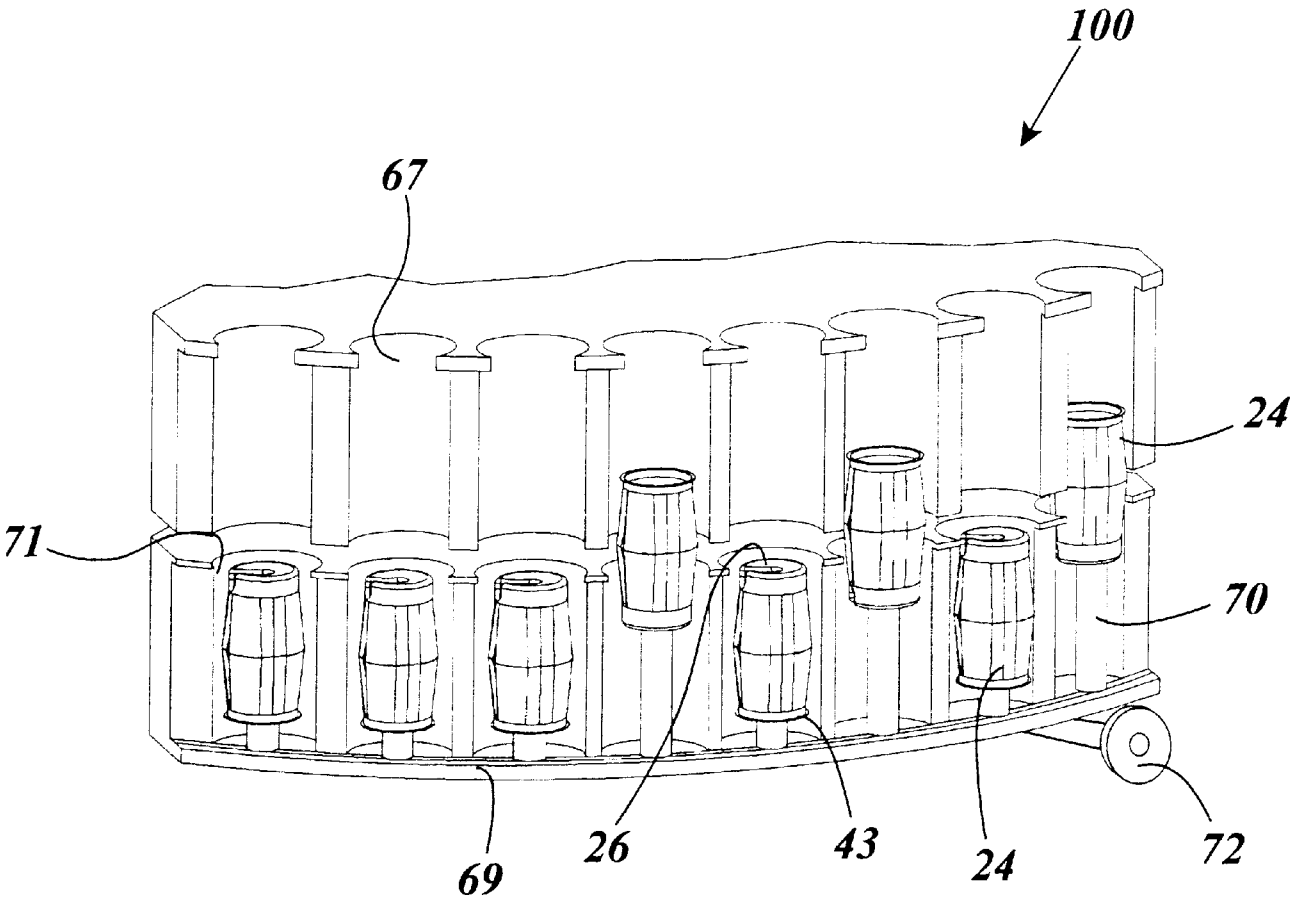
FIG. 11 shows the orientation station in operation during part of the manufacturing process of the apparatus.
Figure 12:
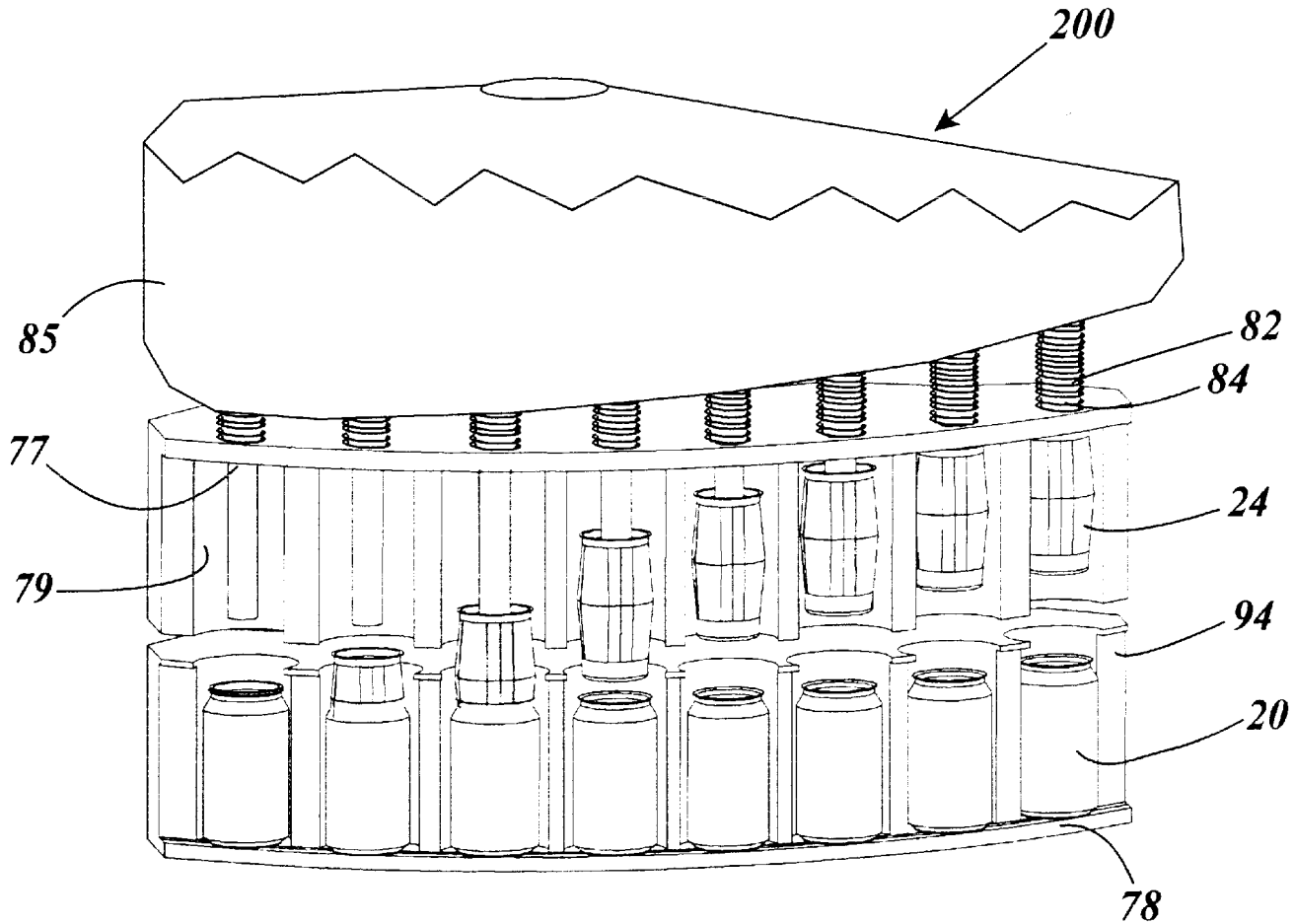
FIG. 12 shows the insertion station inserting receptacles into the containers.
Figure 13:
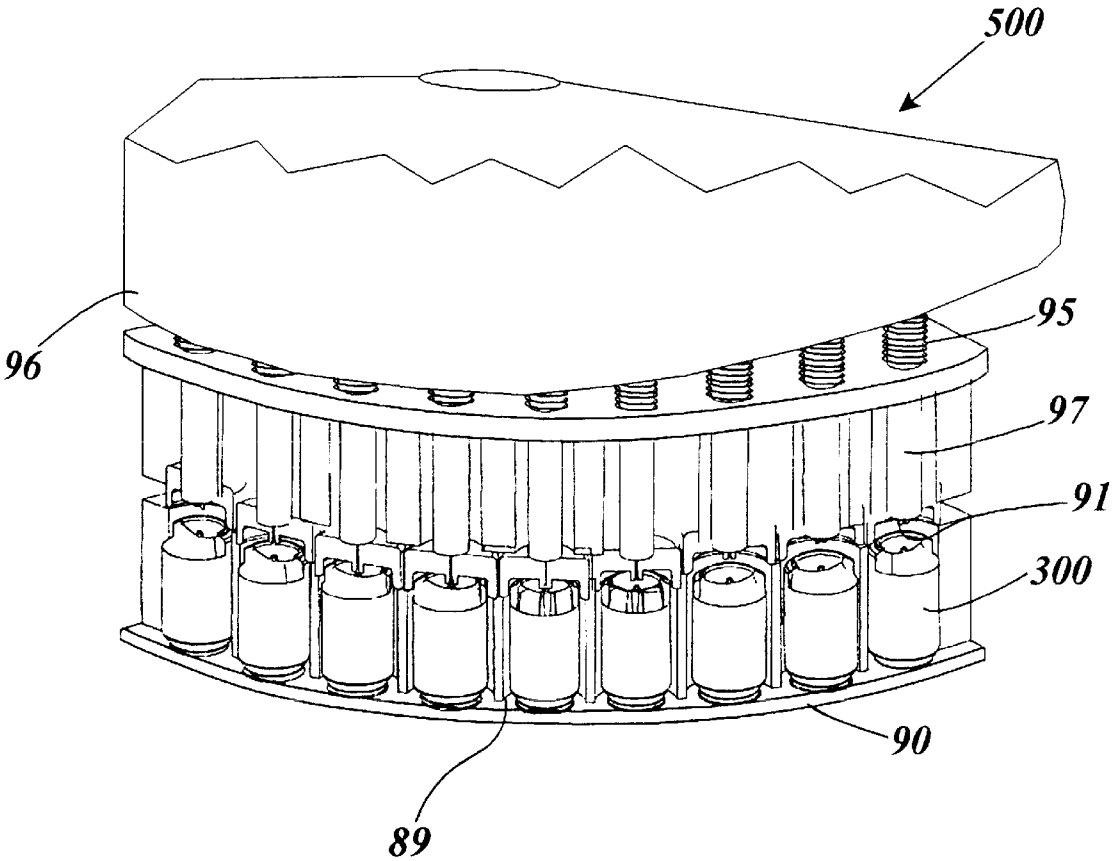
FIG. 13 shows the charging station in operation.
Figure 14:
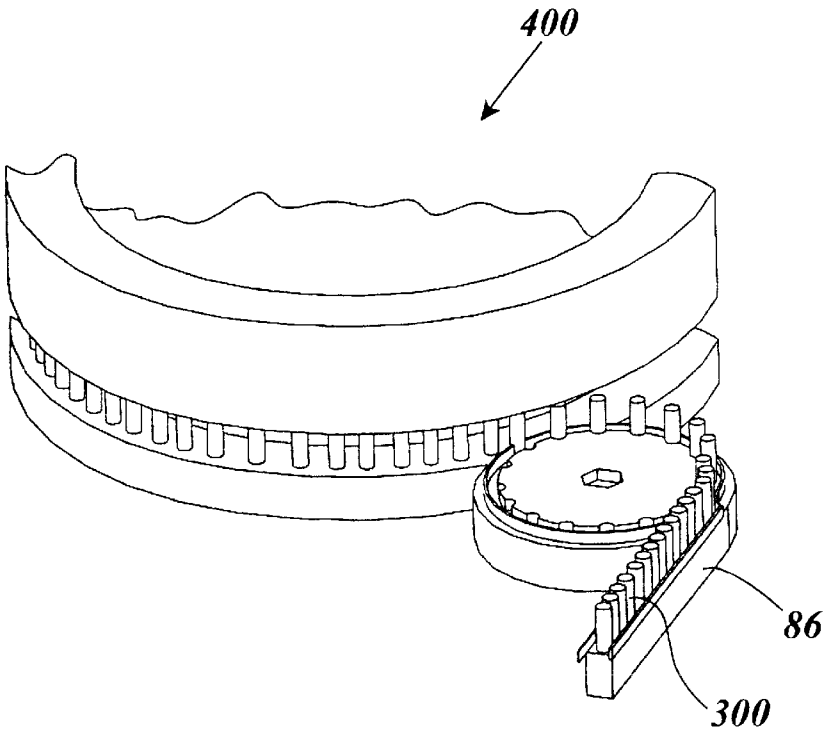
FIG. 14 shows the index wheel of the charging station indexing the assembled apparatus into the charging wheel.
Figure 15:
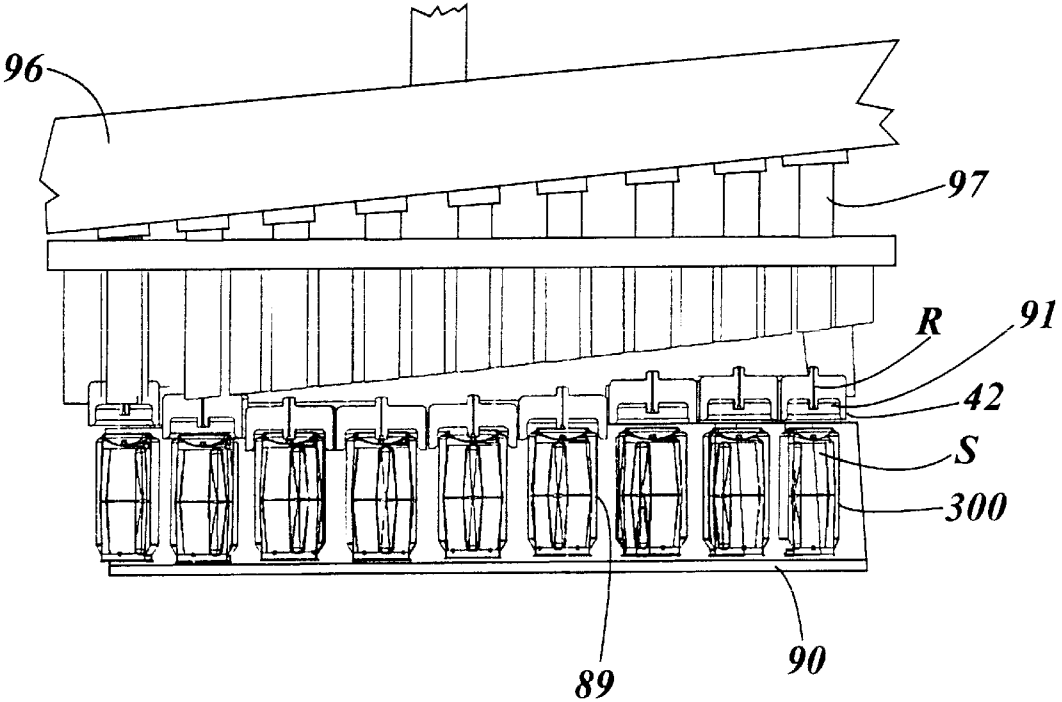
FIG. 15 shows the charging station in operation with the charge valve stem charging and receding from the apparatus.
Figure 16:
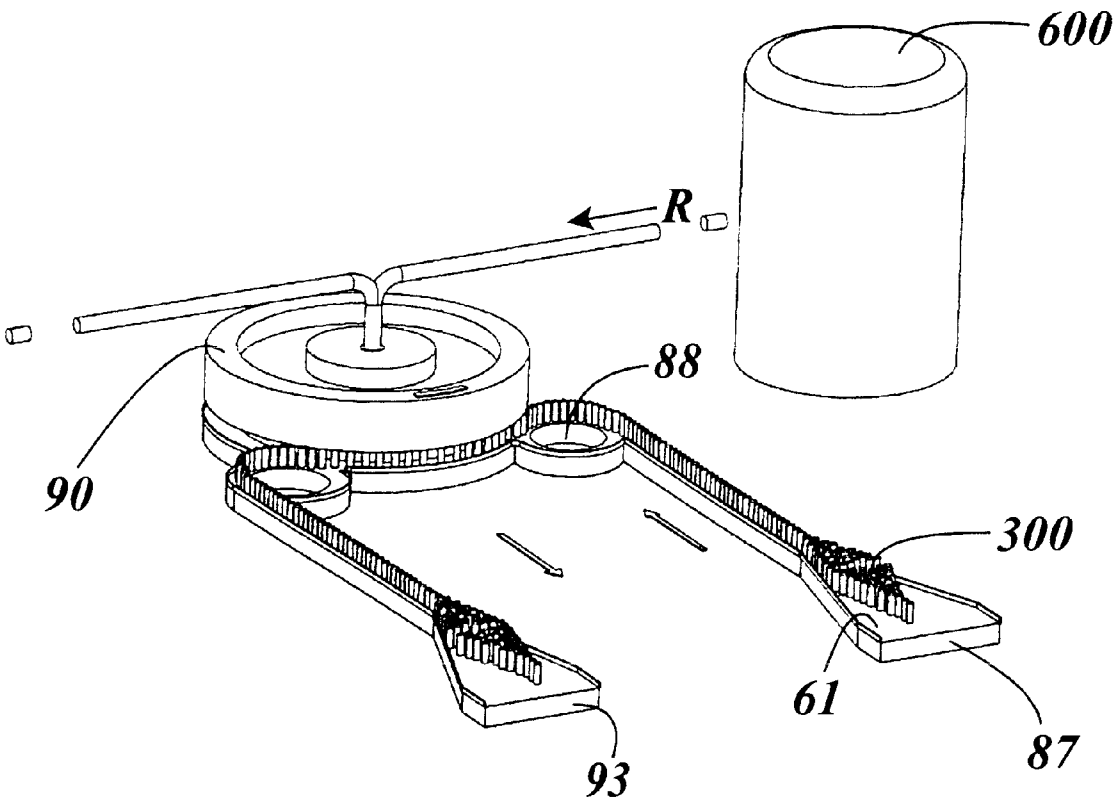
FIG. 16 shows an aerial view of refrigerant storage tank and the charge station with the unused refrigerant being piped back to the storage tank.
Figure 17:
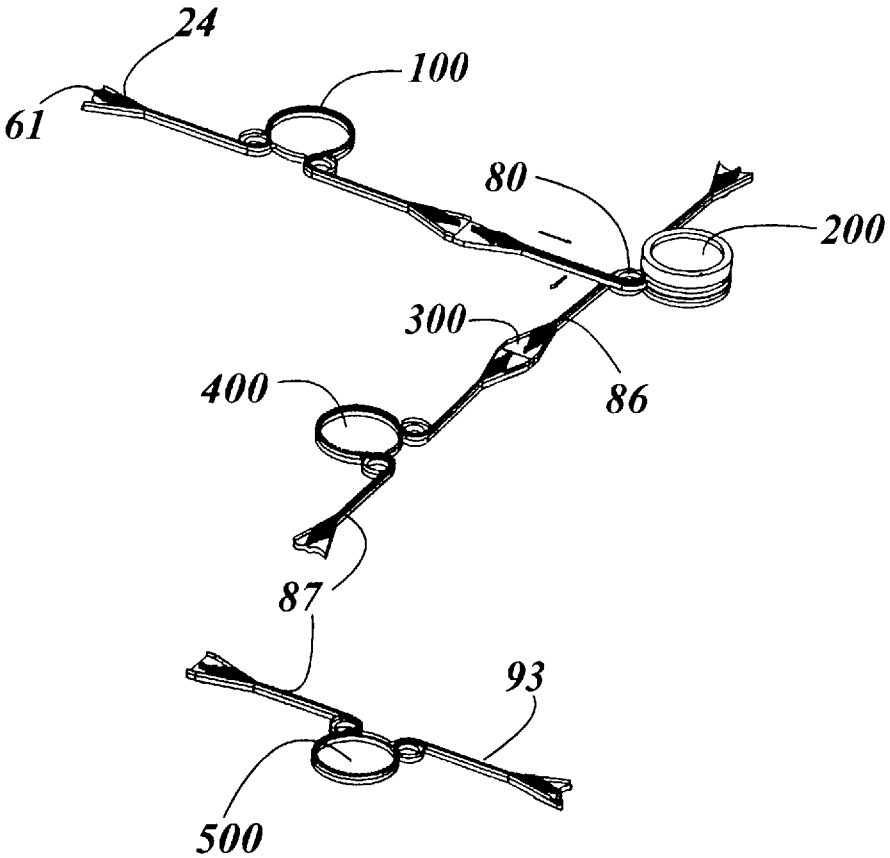
FIG. 17 shows an aerial view of manufacturing process of the apparatus according to a preferred embodiment of the invention.
Figure 19:
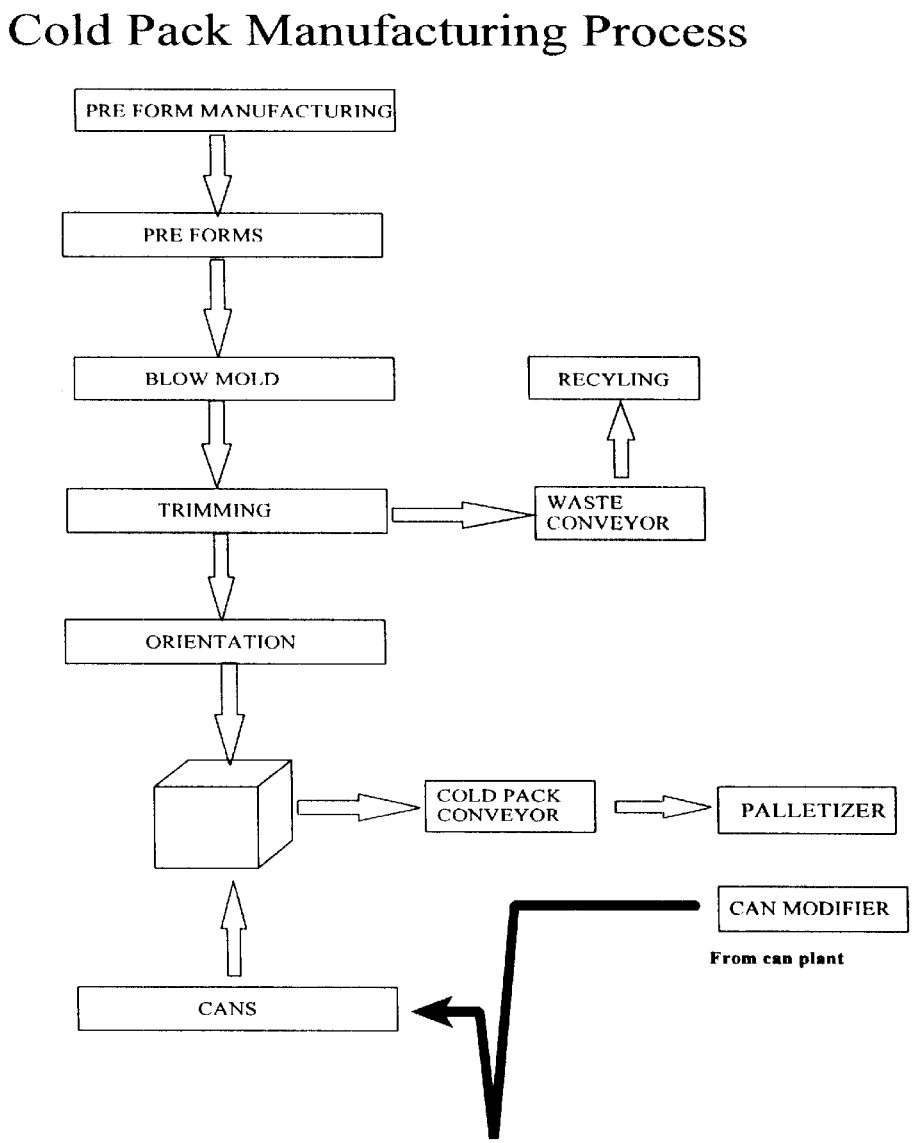
FIG. 19 is a chart showing the manufacturing process stages.
Figure 20:
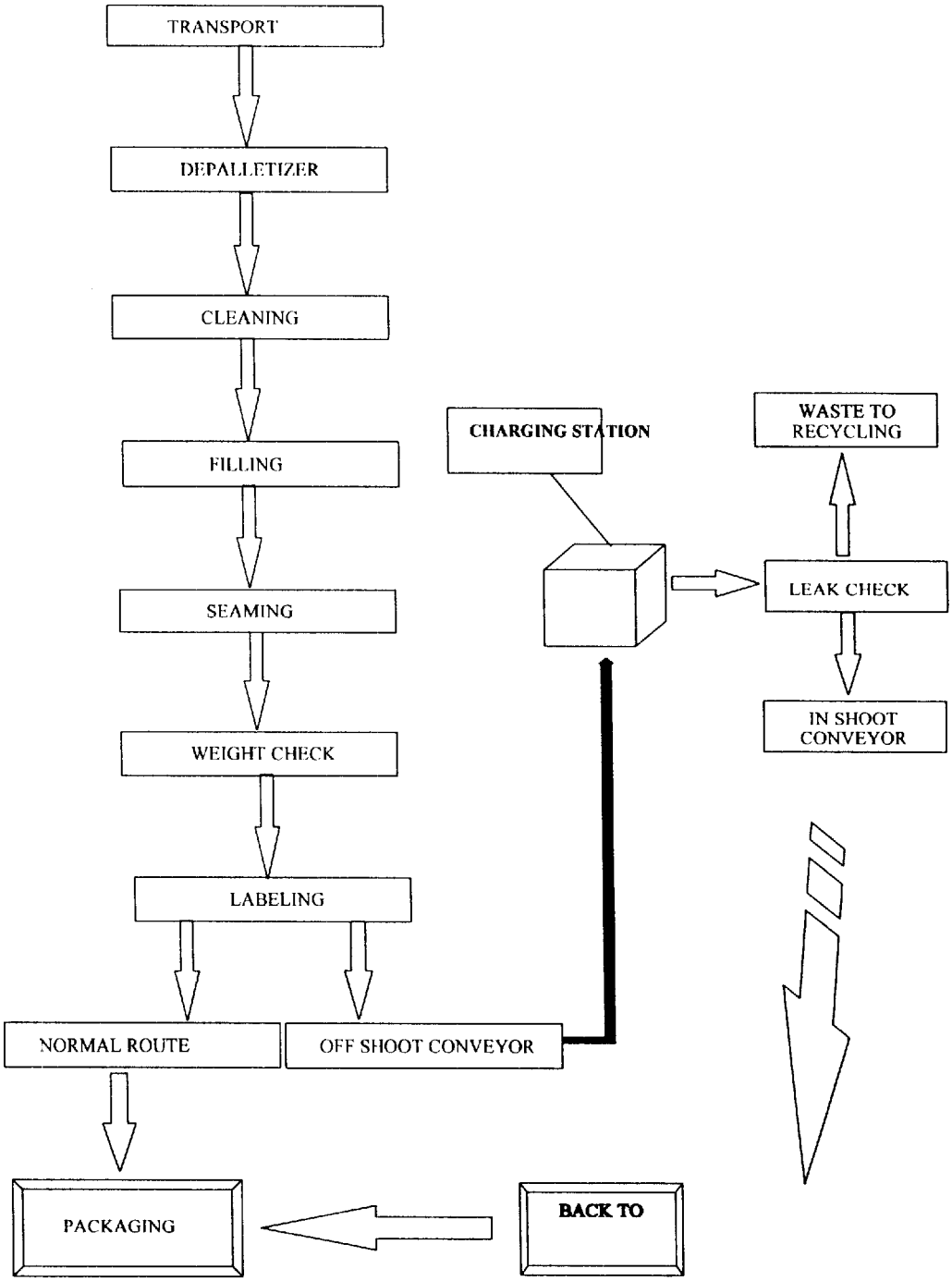
FIG. 20 is a chart showing the stages involved in the beverage filling operation of the apparatus according to the preferred embodiment of the invention.
Figure 21:
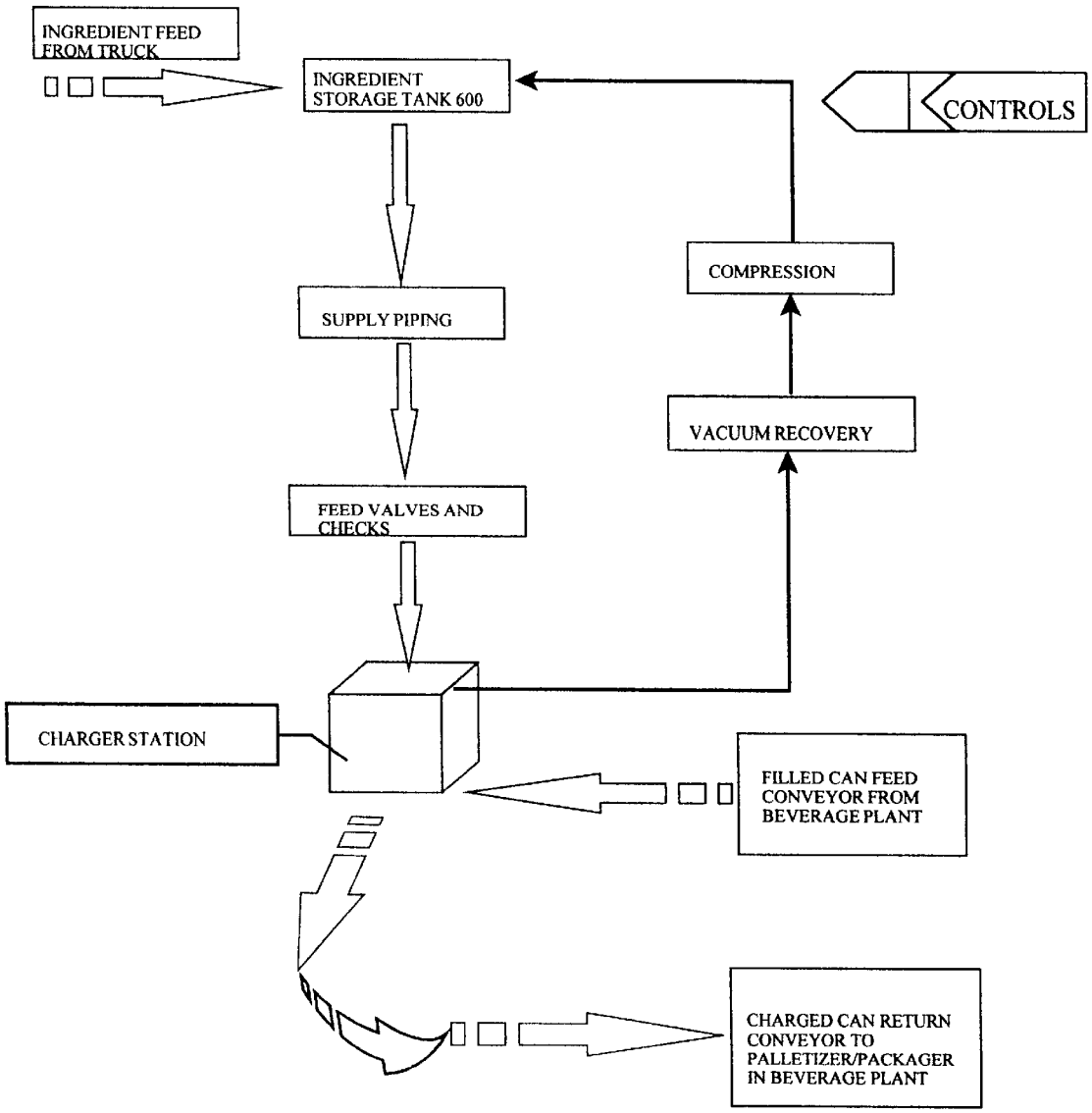
FIG. 21 is a chart showing the charging operation of the apparatus.

Referring to FIGS. 1–21, a self cooling beverage container apparatus 10 is disclosed. Apparatus 10 includes a container 20 such as a metal can with a container side wall 21 and a container bottom wall 22 and container lid 23, the container 20 containing a receptacle 24 having a receptacle side wall 25 and a receptacle bottom wall 26. The receptacle 24 has approximately the overall shape of the container 20 and is sized so that the receptacle 24 abuts the container bottom wall 22 and an substantial annular space S is created between the receptacle side wall 25 and the container side wall 21 to hold a two phase refrigerant mixture R. The upper end of the container side wall 21 is configured as an inwardly angled conical container upper side wall 55 with an open upper rim terminating on an outwardly angled container flange 27 and the receptacle side wall 25 upper end is also configured as an outwardly angled receptacle flange 28 which rests on the container flange 27 and is sealingly pressed to the container flange 27 upon affixing of the container lid 23 to the container flange 27 and receptacle flange 28. The container lid 23 includes beverage release means 29 of conventional design. The container 20 includes a refrigerant passing port 30 fitted with a refrigerant valve 31 which is preferably provided in the container bottom wall 22, for receiving and releasing refrigerant mixture R. The container bottom wall 22 includes a conventional annular bottom rim 32 on which the container 20 rests. The receptacle bottom wall 26 is shaped to match the shape of the container bottom wall 22 to fully abut the container bottom wall 22 and specifically to fully abut the container wall bottom rim 32 so that pressure generated by the beverage filling station filler head inside the receptacle 24 during beverage filling is transmitted fully from receptacle bottom wall 26 to the container bottom wall 22 so that the receptacle 24 in combination with container 20 have the same or greater column compression strength as would a regular beverage container by itself. This preservation of column strength is important during certain manufacturing steps, as below explained. It is important that the maximum diameter of the receptacle 24 be less that the diameter of the container side wall 21, so that the receptacle side wall 25 never contacts the container side wall 21 and thus create radial and lateral stresses.

The receptacle bottom wall 26 also has a cylindrical refrigerant valve receiving structure 34 which includes a cylindrical depression 35 which registers with the refrigerant passing port 30 in the container bottom wall 22, which receives a check valve 36. The refrigerant valve 31 is a check valve which permits refrigerant mixture R to flow into the space S between the container 20 and the receptacle 24 but prevents the refrigerant mixture R from escaping unless released by manually operating the valve 31. It is important that the maximum diameter of the receptacle 24 be substantially less that the diameter of the container side wall 21, so that the receptacle side wall 25 never blocks the flow of refrigerant mixture R between the container side wall 21 and the receptacle side wall 25. One preferred version of the refrigerant valve receiving structure 34 is an annular barrel 37 protruding downwardly from the receptacle bottom wall 26 and molded with the receptacle 24 to be integral with the receptacle 24. The refrigerant valve 31 includes the check valve 36 fitting closely within the bore 38 of the annular barrel 37. The annular barrel 37 is positioned directly above a hollow cylindrical valve seat 39 formed directly in the container bottom wall 22 with a truncated conical tip 40 with a small apex opening 41. The hollow cylinder valve seat 39 contains a check valve 36 made from rubber, an elastomer or a plastic which seals the conical tip 40 when driven downwardly by refrigerant mixture R pressure. Check valve 36 is guided to accurately position itself and seal small apex opening 41, so that a small exposed portion 43 of check valve 36 is exposed through small apex opening 41. Annular barrel 37 acts as a guide for the motion of check valve 36 toward and away from conical tip 40. During charging of refrigerant mixture R, check valve 36 is displaced by the charge valve stem 42, so that it moves away from the sealing position from conical tip 40 and enters annular barrel 37. During charging, the refrigerant mixture R is pumped into the space S between the receptacle 24 and the container 20 through the refrigerant valve 31 at the refrigerant charging station 500. During charging, the refrigerant charge valve stem 42 displaced check valve 36 from the small apex opening 41 and allows refrigerant mixture R to flow around and past the check valve 36 into the space around the receptacle 24.

See FIGS. 10,13,15,and 16. As charging occurs, check valve 36 normally enters annular barrel 37, where check valve 36 remains out of the path of refrigerant mixture R flow until refrigerant mixture R charging is completed and the refrigerant charge valve stem 42 is removed away from the container 20. Then pressure pushes check valve 36 back to reseal the small apex opening 41. Alternately, gravity could be used to reseat check valve 36 back into conical tip 40, to seal small apex opening 41 and trap the refrigerant mixture R inside space S until the apparatus is to be used. It is important that the maximum diameter of the receptacle 24 be less that the diameter of the container side wall 21, so that the receptacle side wall 25 never contacts the container side wall 21 and thus create radial and lateral stresses, and also, so that the receptacle side wall 25 never blocks the flow of refrigerant mixture R between the container side wall 21 and the receptacle side wall 25.

The refrigerant valve 31 may take on many forms such as the shape of a cone or a cylinder with a conical end that mates with conical tip 40, but in all cases, when not being used, the refrigerant valve 31 is held sealingly against the conical tip 40 by pressure of refrigerant mixture R. The receptacle bottom wall 26 also preferably includes a linear depression 59 in the form of a refrigerant drainage channel extending radially from the refrigerant valve receiving structure 34 to and opening out of the circumference of the receptacle bottom wall 26 adjacent to the receptacle side wall 25. During charging, liquified refrigerant mixture R is charged into the container 20 at a pressure higher than that of the refrigerant mixture R at room temperature, so that it remains in liquified form in the container 20. Refrigerant mixture R which remains liquid after charging and even when it comes to thermodynamic equilibrium at room temperature and pressure. When a user wishes to activate the container 20 for cooling, the container 20 is first inverted so that the container wall bottom rim 32 faces upward. This causes the liquified refrigerant mixture R to drain away by means of the refrigerant drain channel, linear depression 59, into the annular space S inside the container 20, and away from the small apex opening 41 to prevent any liquified refrigerant mixture R from exiting the container 20. The user simply presses the small exposed portion 43 allowing the liquified refrigerant mixture R to boil, evaporate and escape through small apex opening 41. Any refrigerant mixture R remaining in liquid state flows through the refrigerant drainage channel 45 into and down the annular space S around the receptacle 24 so that it does not spray out of the small apex opening 41.

The receptacle side wall 25 is shaped for ease of insertion into the container 20 during manufacture. The receptacle side wall 25 is essentially two axially separated half-tube segments 44 interconnected by integral axial and inwardly protruding side wall channels 45 which define side wall bowing segments 46. The receptacle 24 preferably has a wider annular mid-section 47 between the top and bottom of the receptacle. Where the mid-section 47 crosses the side wall bowing segments 46, an outwardly protruding crease or corner defining a bowing segment ridge 48 is provided, at least partly crossing the given side wall bowing segment 64. Application of a light, inwardly directed force F to the bowing segment ridge 48 causes the ridge 48 to become inverted to protrude into the receptacle 24 and the remainder of the side wall bowing segments 46 almost simultaneously follows and is drawn inwardly by the depressed ridge 48 to protrude more deeply into the receptacle 24. The light inwardly directed force F can be created by reducing the internal pressure of the receptacle 24 so that surrounding air pressure collapses the bowing segments 46. Also, the light inwardly directed force F can be created by simply pushing the receptacle bottom wall 26 into the container 20 through the container flange 27, so that the container rim inside walls 49 exert a force F to collapse the bowing segments 46. As a result of this increased inward depression of the bowing segments 46, the half-tube segments 44 are drawn closer to each other so that the profile of the receptacle 24 cross-section progressively changes and the receptacle side wall 25 substantially defines a substantially tubular cylinder 50 sized to fit closely into the container 20 through the container flange 27 and become substantially cylindrical in shape as it enters container 20 through container flange 27. Once the receptacle 24 is fully seated within the container 20, the receptacle 24 is permitted or caused to expand to its original wider shape as the bowing segments 46 again become more shallow pop back to their original configuration. This is a step in the manufacturing process which will be repeated and placed in context in the paragraphs which follow. The receptacle side wall 25 also preferably includes surface area increasing undulations 51 which may form a pattern of discrete elements or be continuous along the receptacle side wall 25. These surface undulations 51 enhance heat transfer through the receptacle walls during refrigerant mixture R release for more rapid and efficient cooling of the beverage 52 within the receptacle 24.

The receptacle side wall 25 preferably further includes an outwardly protruding bulge stop 53 close to the upper and of the receptacle side wall 54 which abuts an inwardly angled conical container upper side wall 55 after receptacle 24 insertion and expansion into the container 20. This bulge stop 53 helps hold the receptacle 24 in the container 20 until the container lid 23 is seamed in place. Thus, advantageously, during the washing of the container 20 and receptacle 24 assembly, the receptacle 24 will not dislodge from its snug location within container 20.

Preferred Manufacturing Process

A method of manufacturing a self-cooling container apparatus 10 containing a beverage or other food item as described in U.S. Pat. No. 6,065,300. The terms "beverage", "water", "juices", "food item" and "container contents" are considered equivalent for purposes of this application and are used interchangeably.

The method of manufacture generally involves the broad steps of blow molding the receptacles from plastic preforms designed for maximum efficiency in production from PET plastic material from Eastman Kodak or other suppliers. Preferably, the plastic preforms are injection-stretch-blow-molded from PET, a plastic material commonly used for making plastic beverage bottles. The steps of manufacture also include trimming off the top blow dome 18 of receptacle 24 as waste around the top blow dome 19 to create an open flanged receptacle 24 with an outwardly protruding receptacle flange 28; orienting the receptacle for insertion into container 20; inserting each receptacle 24 into a container 20; filling the receptacle 24 with beverage; seaming the container lid 23 onto the combined receptacle flange 28 and container flange 27; and charging the annular space S between the receptacle 24 and container 20 with refrigerant mixture R.

These broad steps include individual and specific steps, which are described in detail in the following paragraphs.

See the flow charts of FIGS. 18–21. First the container 20 and receptacle 24 are formed. The container 20 is formed by stamping and spinning out of sheet aluminum or steel according to well known and prevailing methods. The receptacle 24 is blow molded, and has a receptacle top portion with a wider receptacle side wall section which narrows at the top to a tubular opening 17 resembling a spout having top portion representing a blow dome 18. The blow dome 18 is removed by trimming the receptacle dome wall 19 using 25 Watt laser beam, a hot wire, or by a sharp knife edge. The finished and trimmed receptacles 24 are received in a receptacle holding bin where they are piped through a linear serializer 61. The linear serializer 61 orients the receptacles in a linear axial manner. The trimmed wastes 62 are carried away on a waste conveyor 63 for melting and recycling to form more receptacles. The linear serializer 61 directs the receptacle 24 through a progressively smaller conical hopper 64, where the receptacle 24 is oriented axially in a linear series on a insertion conveyor belt 65, or on a vacuum pipe conveyor 66. The receptacle axis is oriented along the linear serializer 61 axis. The receptacles 24 are then transported to the receptacle orienting station 84. In the preferred embodiment, the orientation station 100 has equally spaced cylindrical receptacle holding recesses 67 along the circumference of an orientation wheel 69, where each receptacle 24 is captured as by a cylindrical receptacle holding recess 67 intercepts the delivery vacuum pipe conveyor 66. The cylindrical receptacle holding recesses 67 are designed to hold the receptacle loosely and co-axially, but securely as the orientation wheel 69 rotates. Beneath each cylindrical receptacle holding recess 67 an orientation spindle 70 is provided along the same axis. The orientation wheel 69 thus automatically allows each receptacle 24 that is oriented with the receptacle 24 opening facing the orientation spindle 70, to fall down around the orientation spindle 70 below the receptacle holding area 71 of the cylindrical receptacle holding recess 67, whereas receptacles 24 with the receptacle bottom wall 26 resting on the orientation spindle 70 simply rest on the orientation spindle 70 in the cylindrical receptacle holding recess 67 area as the orientation wheel 69 rotates. Any receptacles 24 sitting on top of the orientation spindle 70 is simple accumulated linearly and sped off tangentially from the orientation wheel 69 to the next manufacturing operation. Thus, a portion of the orientation wheel 69 after this tangential take off point will have only receptacles 24 of the wrong orientation. An orientation cam 72 allows the orientation spindle 70 to automatically fall below the wrongly oriented receptacle flange 28, so that the receptacle 24 dropping over the orientation spindle 70 is delivered by rotation of the orientation wheel 69 to a recycling bin where they are again delivered by an orientation conveyor 73 to the orientation station 100 for re-sorting by orientation.

Each container 20 is delivered to a valve seat forming station 74 where a base valve seat 39 is formed into each container bottom wall 22 by progressively stamping the container bottom wall 22 to form the desired valve seat 39. Then the valve forming station 74 simply drops the check valve 36 into the valve seat 39 so that the check valve 36 sits sealingly in valve seat 39 by the force of gravity. Then the container 20 is delivered to the receptacle insertion station 200 where it is brought into position below a receptacle. The insertion station 200 comprises two portions, an upper receptacle receiving wheel 79 and a lower container receiving wheel 78. Each container 20 is indexed into a cylindrical container aligning recess 94 circumferentially located on container receiving wheel 78 by a container indexing wheel 80 of conventional design, while simultaneously, a receptacle 24 is also indexed above the said indexed container 20 by a lock-stepped receptacle indexing wheel 81 into a cylindrical receptacle aligning recess 95 on the upper receptacle receiving wheel 79. Thus the receptacles 24 are radially position on the insertion station 200 at the same location as the containers 20. As receptacle receiving wheel 79 rotates, an insertion cam 85 along the circumference of the receptacle receiving wheel 79 pushes insertion spindle 82 into the receptacle 24 to abut the receptacle bottom wall 26. The insertion spindle 82 progressively pushes receptacle 24 into a correspondingly aligned container 20 while at the same time a slight vacuum is applied inside the receptacle 24. A force F is created by the combination of the vacuum force and the radial component of the contact force the receptacle side wall 22 makes with the container rim inside wall 49. The force F inward depresses bowing segments 46 and causes the half-tube segments 44 to be drawn closer to each other so that the profile of the receptacle 24 cross-section progressively changes and the receptacle side wall 25 becomes a substantially tubular cylinder 50 sized to fit easily through the container rim inside wall 49 without deforming container 20. through the container flange 27. The receptacle 24 is pushed into container 20 until the receptacle flange 28 rests evenly on the container flange 27, and cylindrical refrigerant valve receiving structure 34 registers with the refrigerant passing port 30 in the container bottom wall 22. The vacuum is releases, and the receptacle side walls 25 pop back to their original shapes by the internal resistive forces of the plastic material, at the same time, a spring 84 pushes the insertion spindle 82 back upwardly as the insertion cam 85 recedes away from the assembly 300. The assemblies 300 delivered by rotation of the insertion station 200 to a filler delivery conveyor 86 which transports the assemblies 300 to the beverage filling plant 400.

The assemblies 300 comprising of container 20 and receptacle 24 then pass through the beverage filling plant 400 as if they are ordinary containers, and are processed through the beverage filling plant 400 in the same manner as ordinary containers. The beverage filling line process includes the steps of transporting the assemblies 300 to the beverage filling plant 400; cleaning and assemblies 300 by filling the receptacle 24 within the container 20 with beverage 52; seaming the lid 23 onto the receptacle flange 28 and the container flange 27 ; checking the weight of the filled container; labeling the container; checking for any leaks; and conveying the assemblies 300 to the refrigerant mixture R charging station 500.

A process description chart of manufacture of the self-cooling beverage container appears as FIGS. 18–21.

After the beverage filling process, the filled container and receptacle assemblies 300 are delivered to a charging station 500 by charge delivery conveyor 87. Again a charge index wheel 88 is used to index each assembly 300 into a slot 89 along the circumference of charging wheel 90. A charge valve 91 is provided at the location of each assembly 300. The charge valve 91 is pressed against the small exposed portion 43 of check valve 36 through conical tip 40 of the valve seat 39 on the container bottom wall 22 of each assembly 300. Thus, the annular space S between the container 20 and receptacle 24 is charged with refrigerant mixture R.

The annular space S within each assembly 300 is charged according to the following method: liquified refrigerant mixture R is fed from supply trucks into a refrigerant mixture R storage tanks 600; feeding the refrigerant mixture R through supply piping to feed valves and check valves into the charging station 500; recovering excess refrigerant gas with a vacuum line 92 and compressing the recovered refrigerant mixture R and delivering the said compressed refrigerant mixture R back into the storage tank 600; placing the charged container assemblies 300 on return conveyors 93 to a palletizer/package station within the beverage filling plant 400 for packaging and shipping to consumers.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A self-cooling container apparatus for retaining a food item, comprising:

a container having a tubular container side wall and a container bottom wall having a certain configuration and being integrally joined to said container side wall and having a container lid; a receptacle having a tubular receptacle side wall and a receptacle bottom wall integrally joined to said receptacle side wall, said receptacle bottom wall having a configuration matching the certain configuration of said container bottom wall and abutting said container bottom wall such that pressure greater than ambient pressure within said receptacle is fully transmitted to said container bottom wall to enhance container column strength; said receptacle side wall and container side wall being spaced substantially apart from each other to define therebetween a substantial annular space for retaining a liquified and gaseous refrigerant mixture, said container side wall having a container side wall upper end configured as a container flange and said receptacle side wall having a receptacle side wall upper end configured as a receptacle flange which rests on said container flange and is sealed to said container flange upon affixing of said container lid over said receptacle flange and said container flange;

and food item release means for releasing said food item from said receptacle and said container.

2. The apparatus of claim 1, wherein said container flange is angled outwardly and said receptacle flange is angled outwardly.

3. The apparatus of claim 1,, additionally comprising a refrigerant passing container port fitted with a refrigerant valve for receiving and releasing refrigerant.

4. The apparatus of claim 3, wherein said refrigerant passing container port is located in said container bottom wall.

5. The apparatus of claim 1, wherein the configuration of said container bottom wall comprises an outwardly protruding annular container bottom wall rim on which said container rests; and wherein the configuration of said receptacle bottom wall comprises an outwardly protruding annular receptacle bottom wall rim corresponding in size and shape to said container bottom wall rim such that said receptacle bottom wall rim nests within and abuts said container bottom wall rim and transmits pressure within said receptacle to said container bottom wall rim.

6. A self-cooling container apparatus for retaining a food item, comprising:

a container having a tubular container side wall and a container bottom wall having a certain configuration and being integrally joined to said container side wall and having a container lid, said container bottom wall having a refrigerant passing container port;

a receptacle having a tubular receptacle side wall and a receptacle bottom wall integrally joined to said receptacle side wall; said receptacle side wall and said container side wall being spaced apart from each other to define therebetween a substantially annular space for retaining refrigerant, said container side wall having a container side wall upper end configured as a container top flange and said receptacle side wall having a receptacle side wall upper end configured as a receptacle top flange which rests on said container top flange and is sealed to said container top flange upon affixing of said container lid over said receptacle top flange and said container top flange;

and food item release means for releasing said food item from said receptacle and said container;

said receptacle bottom wall comprising a refrigerant valve receiving structure comprising a cylindrical depression which registers with said refrigerant passing container port in said container bottom wall for receiving a check valve.

7. The apparatus of claim 6, wherein said container flange is angled outwardly and said receptacle flange is angled outwardly.

8. The apparatus of claim 6, additionally comprising a refrigerant passing container port fitted with a refrigerant valve for receiving and releasing refrigerant.

9. The apparatus of claim 8, wherein said refrigerant passing container port is located in said container bottom wall.

10. The apparatus of claim 1, wherein the configuration of said container bottom wall comprises an outwardly protruding annular container bottom wall rim on which said container rests; and wherein the configuration of said receptacle bottom wall comprises an outwardly protruding annular receptacle bottom wall rim corresponding in size and shape to said container bottom wall rim such that said receptacle bottom wall rim nests within and abuts said container bottom wall rim and transmits pressure within said receptacle to said container bottom wall rim.

11. The apparatus of claim 6, wherein said refrigerant valve is a check valve permitting refrigerant to flow into the annular space between said receptacle side wall and said container side wall, and prevents the refrigerant from escaping from said container unless released by manually operation of said refrigerant valve.

12. The apparatus of claim 7, wherein said refrigerant valve receiving structure comprises:

an annular barrel protruding downwardly from said receptacle bottom wall; a check valve fitting closely within said annular barrel, said annular barrel being positioned to register with a downward deformation of said container bottom wall defining a hollow cylinder structure with a conical tip segment at the lower end of said hollow cylinder structure, said refrigerant passing container port being located at the lower end of said conical tip segment;

and a sealing check valve within said hollow cylinder structure resting within and sealing said conical tip section against refrigerant flow out of said container through said conical tip section when driven downwardly by refrigerant pressure above ambient pressure, and which enters said annular barrel when displaced upwardly by a refrigerant filling structure entering said refrigerant passing container port.

13. The apparatus of claim 11, wherein said refrigerant valve receiving structure comprises a tubular flange formed into said container bottom wall and opening at its lower end to define said refrigerant passing container port; and a self-contained check valve fitted sealingly within said tubular flange.

14. A self-cooling container apparatus for retaining a food item, comprising:

a container having a tubular container side wall and a container bottom wall having a certain configuration and being integrally joined to said container side wall and having a container lid, said container bottom wall having a refrigerant passing container port;

a receptacle having a tubular receptacle side wall and a receptacle bottom wall integrally joined to said receptacle side wall; said receptacle side wall and said container side wall being spaced apart from each other to define therebetween a substantially annular space for retaining refrigerant, said container side wall having a container side wall upper end configured as a container top flange and said receptacle side wall having a receptacle side wall upper end configured as a receptacle top flange which rests on said container top flange and is sealed to said container top flange upon affixing of said container lid over said receptacle top flange and said container top flange;

and food item release means for releasing said food item from said receptacle and said container;

said receptacle bottom wall comprising a refrigerant valve receiving structure comprising a cylindrical depression which registers with said refrigerant passing container port in said container bottom wall for receiving a check valve;

a refrigerant drainage channel depressed inwardly into said receptacle bottom wall and extending radially from said refrigerant valve to and out of the side of said receptacle;

such that during charging, said refrigerant in liquid state charged into said container during refrigerant filling and remaining liquid after refrigerant filling and after temperature and pressure equilibrium with the surrounding atmosphere after the apparatus is charged and stored and remaining at the bottom of said container between said container bottom wall and said receptacle bottom wall drains through said refrigerant drainage channel and along the annular space upon inversion of said container by a user to open said refrigerant valve to release the refrigerant to cool the food item, such that liquid refrigerant is not adjacent to said refrigerant valve and does not spray out of said container upon opening of said refrigerant valve.

15. A self-cooling container apparatus for retaining a food item, comprising: a container having a tubular container side wall and a container bottom wall having a certain configuration and being integrally joined to said container side wall and having a container lid;

a receptacle having a tubular receptacle side wall and a receptacle bottom wall integrally joined to said receptacle side wall; said receptacle side wall and container side wall being spaced apart from each other to define therebetween an annular space for retaining refrigerant, said receptacle tubular side wall comprising two axially separated half tube segments interconnected by integral axial and inwardly protruding side wall channels which define side wall bowing segments, said receptacle having a wider annular mid-section between the top and bottom of the receptacle, such that application of a certain inwardly directed force to the bowing segment ridges causes the ridges to become inverted to protrude into the receptacle and the depressed ridges to protrude more deeply inwardly and the remainder of the side wall bowing segments to draw closer together, reducing the receptacle cross-section sufficiently to fit into said container;

and food item release means for releasing said food item from said receptacle and said container.

16. The apparatus of claim 15, wherein said receptacle side wall comprises surface area increasing undulations for enhancing heat transfer through said receptacle side wall during refrigerant release for more rapid and efficient cooling of the food item within said receptacle.

17. The apparatus of claim 15, wherein said receptacle side wall comprises an outwardly protruding bulge stop, located close to the upper end of said receptacle side wall, which abuts said container top flange after receptacle insertion into said container, for resisting movement of said receptacle out of said container.

18. A process of manufacturing a self-cooling container apparatus for retaining a food item, said apparatus comprising a container having a tubular container side wall and a container bottom wall having a certain configuration and being integrally joined to said container side wall and having a container lid; a receptacle having a tubular receptacle side wall and a receptacle bottom wall integrally joined to said receptacle side wall; said receptacle side wall and container side wall being spaced apart from each other to define therebetween an annular space for retaining refrigerant; and food item release means for releasing said food item from said receptacle and said container; comprising the steps of:

orienting said receptacles for insertion into containers;

inserting each said receptacle into a containers;

filling each said receptacle with beverage;

filling the annular space between said container side wall and said receptacle side wall with refrigerant;

seaming said container lid onto said container;

and charging the annular space between the receptacle and container with refrigerant.

19. A process of manufacturing a self-cooling container apparatus for retaining a food item, said apparatus comprising a container having a tubular container side wall and a container bottom wall having a certain configuration and being integrally joined to said container side wall and having a container lid; a receptacle having a tubular receptacle side wall and a receptacle bottom wall integrally joined to said receptacle side wall; said receptacle side wall and container side wall being spaced apart from each other to define therebetween an annular space for retaining refrigerant, said receptacle tubular side wall comprising two axially separated half tube segments interconnected by integral axial and inwardly protruding side wall channels which define side wall bowing segments, said receptacle having a wider annular mid-section between the top and bottom of the receptacle, such that upon application of a certain inwardly directed force to the bowing segment ridges causes the ridges to become inverted to protrude into the receptacle and the depressed ridges to protrude more deeply inwardly and the remainder of the side wall bowing segments to draw closer together, reducing the receptacle cross-section sufficiently to fit into said container; and food item release means for releasing said food item from said receptacle and said container; comprising the steps of:

orienting said receptacles for insertion into containers;

applying a certain inwardly directed force to the bowing segment ridges to cause said ridges to become inverted to protrude into said receptacle and said ridges to protrude more deeply inwardly and the remainder of the side wall bowing segments to draw closer together, reducing the cross-section of said receptacle sufficiently to fit into said container;

inserting each said receptacle into a container;

filling each said receptacle with beverage;

filling the annular space between said container side wall and said receptacle side wall with refrigerant;

seaming said container lid onto said container;

and charging the annular space between the receptacle and container with refrigerant.

20. The process of claim 19, wherein said certain inwardly directed force is applied by creating at least a partial vacuum within each said receptacle.

21. A process of manufacturing a self-cooling container apparatus for retaining a food item, said apparatus comprising a container having a tubular container side wall and a container bottom wall having a certain configuration and being integrally joined to said container side wall and having a container lid; a receptacle having a tubular receptacle side wall and a receptacle bottom wall integrally joined to said receptacle side wall; said receptacle side wall and container side wall being spaced apart from each other to define therebetween an annular space for retaining refrigerant; and food item release means for releasing said food item from said receptacle and said container; comprising the steps of: delivering a series of said receptacles to an orientation wheel on receptacle conveyor means;

sequentially capturing said receptacles in said receptacle holding recesses along the circumference of said orientation wheel such that said receptacles are held loosely and co-axially as said orientation wheel rotates;

placing below each receptacle an opening containing a substantially vertical spindle, such that the bottom wall of receptacles oriented upright rest on said spindles, and such that receptacles oriented up-side down receive the given said spindle below the given receptacle and slide onto the spindle and out of said orientation wheel;

delivering the upright said receptacles remaining in said orientation wheel to a receptacle insertion station;

inserting each said receptacle into a containers;

filling each said receptacle with beverage;

filling the annular space between said container side wall and said receptacle side wall with refrigerant;

seaming said container lid onto said container;

and charging the annular space between the receptacle and container with refrigerant.

22. A receptacle orientation station for orienting receptacles for insertion into containers to form self-cooling container structures for retaining food items, comprising:

a plurality of receptacles, each said having a tubular receptacle side wall and a receptacle bottom wall integrally joined to said receptacle side wall;

receptacle delivery means for conveying a series of said receptacles;

a receptacle wheel being rotatably and having receptacle wheel rotation drive means, said receptacle wheel having a receptacle wheel circumference with a series of spaced apart receptacle receiving recesses along the circumference said receptacle wheel, each recess for receiving and retaining a receptacle delivered to said receptacle wheel by receptacle delivery means, said recesses holding said receptacles substantially co-axially as said receptacle wheel rotates;

a plurality of receptacle spindles, each said receptacle spindle being located beneath each said recess substantially along the axis of each said receptacle in each said recess; such that any said receptacles oriented with the receptacle opening facing said spindle falls down around said spindle below said recesses, and such that any said receptacles oriented with the receptacle opening facing away from their respective spindles rest on top of the spindles and continue to rotate with said receptacle wheel; and such that any said receptacles remaining within said receptacle wheel simply rest on the orientation spindle as the said receptacle wheel rotates for removal to another manufacturing station and any said receptacles having exited their receptacles and resting around their respective spindles are removed for reorientation.

23. The orientation station of claim 22, wherein said spindles retractably extend through ports in a orientation spindle wheel and wherein said apparatus further comprises spindle retraction means which retract said spindles out of any said receptacles resting over said spindles, such that said receptacles are freed from removal from the reorientation station.

24. The orientation station of claim 23, additionally comprising an orientation cam in camming contact with said spindles for retracting said spindles into and extending said spindles out of said orientation spindle wheel such that said spindles fall below the flanges of receptacles resting over said spindles such that any said receptacles dropping over said spindles are delivered by rotation of said orientation spindle wheel to a recycling station where said receptacles are again delivered by to said orientation station.

* * * * *